US012545455B2

(12) United States Patent
Wintring et al.

(10) Patent No.: US 12,545,455 B2
(45) Date of Patent: Feb. 10, 2026

(54) APPARATUS AND METHOD FOR ORIENTING POUCHES HEAD-TO-TOE

(71) Applicant: R.A Jones & Co., Covington, KY (US)

(72) Inventors: Jeffrey D. Wintring, Florence, KY (US); Robert M. Kalany, Florence, KY (US); Andrew J. Nelson, Davenport, IA (US); Jeffrey E. Farmer, Cincinnati, OH (US)

(73) Assignee: R.A Jones & Co., Covington, KY (US)

( * ) Notice: Subject to any disclaimer, the term of this patent is extended or adjusted under 35 U.S.C. 154(b) by 85 days.

(21) Appl. No.: 18/652,833

(22) Filed: May 2, 2024

(65) Prior Publication Data

US 2024/0367837 A1 Nov. 7, 2024

Related U.S. Application Data

(60) Provisional application No. 63/499,832, filed on May 3, 2023.

(51) Int. Cl.
*B65B 35/36* (2006.01)
*B65B 35/40* (2006.01)
(Continued)

(52) U.S. Cl.
CPC ..... *B65B 35/36* (2013.01); *B65B 35/40* (2013.01); *B65B 35/56* (2013.01); *B65B 57/10* (2013.01)

(58) Field of Classification Search
CPC ..... B65B 35/36; B65B 35/38; B65B 35/40; B65B 35/50; B65B 35/56; B65B 35/58; B65B 5/105; B65B 57/10
See application file for complete search history.

(56) References Cited

U.S. PATENT DOCUMENTS 4,742,778 A * 5/1988 Morishita ..... E01B 25/28 104/291
5,778,640 A * 7/1998 Prakken ..... B65B 5/061 53/538

(Continued)

FOREIGN PATENT DOCUMENTS

WO 2022200940 A1 9/2022

OTHER PUBLICATIONS

Wikipedia, Delta robot, retrieved from https://en.wikipedia.org/wiki/Delta_robot on Apr. 27, 2023 (4 pages).

(Continued)

*Primary Examiner* — Himchan Song
(74) *Attorney, Agent, or Firm* — Wood Herron & Evans LLP

(57) ABSTRACT

A product transfer apparatus for transferring product between a horizontal form, fill, and seal machine and a cartoner machine is provided. The product transfer apparatus includes an electromagnetic motor table configured to define a plurality of pre-selected zones and a plurality of moving elements configured to float over a surface of the electromagnetic motor table and move between one or more of the pre-selected zones. The product transfer apparatus further includes a product delivery device configured to deposit one or more products in a pre-selected common orientation, relative to a longitudinal axis of the product transfer apparatus, onto one or more moving elements of the plurality of moving elements, respectively, at a first pre-selected zone of the plurality of pre-selected zones such that each of the one or more moving elements receives a single product from the product delivery device in the pre-selected common orientation at the first pre-selected zone. The product transfer apparatus further includes a product picking device configured to pick a group of products constituted by one or more products from a pre-selected group of the (Continued)

plurality of moving elements at a second pre-selected zone of the plurality of pre-selected zones, wherein the orientation of one or more products of the group of products at the second pre-selected zone is different from the pre-selected common orientation of the products received at the first pre-selected zone, and deposit the one or more products of the group of products into at least one cartoner bucket of a cartoner.

13 Claims, 27 Drawing Sheets

(51) Int. Cl.
*B65B 35/56* (2006.01)
*B65B 57/10* (2006.01)

(56) References Cited

U.S. PATENT DOCUMENTS 6,019,213 A * 2/2000 Schubert ..... B65G 47/5113 198/419.3
6,505,730 B1 * 1/2003 Linder ..... B07C 3/08 198/370.01
9,202,719 B2 * 12/2015 Lu ..... H02K 1/2795
11,136,199 B2 * 10/2021 Choplin ..... B65G 54/02
11,780,618 B2 * 10/2023 Kuhn ..... B65B 9/20 53/552
11,801,961 B2 * 10/2023 Dersch ..... B65B 1/36
2010/0146909 A1 * 6/2010 Malenke ..... B65B 35/50 53/447
2014/0083062 A1 * 3/2014 Arimatsu ..... B65B 5/06 53/564
2014/0119875 A1 * 5/2014 Job ..... B65G 47/71 414/800
2017/0050332 A1 * 2/2017 Bauer ..... A22C 17/0093
2017/0203865 A1 * 7/2017 Kalany ..... B25J 15/0061
2022/0135351 A1 * 5/2022 Hickman ..... B65B 5/108 414/294
2023/0034751 A1 * 2/2023 Voelkl ..... B65B 57/16
2025/0115430 A1 * 4/2025 Amba ..... B65G 1/1378

OTHER PUBLICATIONS

ACOPOS 6D, B&R Industrial Automation, B&R heralds the beginning of multidimensional manufacturing with ACOPOS 6D, retrieved from https://www.br-automation.com/en-us/products/mechatronic-systems/acopos-6d/ on Apr. 27, 2023 (5 pages).
"Flying Motion XPlanar", Nov. 1, 2018 (Nov. 1, 2018), pp. 1-28, XP055668904, retrieved from the Internet: URL:https://download.beckhoff.com/download/Document/catalog/Beckhoff_XPlanar d. pdf [retrieved on Feb. 14, 2020].
European Patent Office, Invitation to Pay Additional Fees And, Where Applicable, Protest Fee, Partial International Search Report and Provisional Opinion, International Application No. PCT/US2024/027388, mailed Sep. 5, 2024 (10 pages).
European Patent Office, Written Opinion of the International Preliminary Examining Authority, International Application No. PCT/US2024/027388, mailed Mar. 27, 2025 (8 pages).
European Patent Office, International Search Report and Written Opinion of the International Searching Authority, International Application No. PCT/US2024/027388, mailed Oct. 30, 2024 (17 pages).
European Patent Office, International Preliminary Report on Patentability, International Application No. PCT/US2024/027388, mailed Jul. 18, 2025 (11 pages).

* cited by examiner

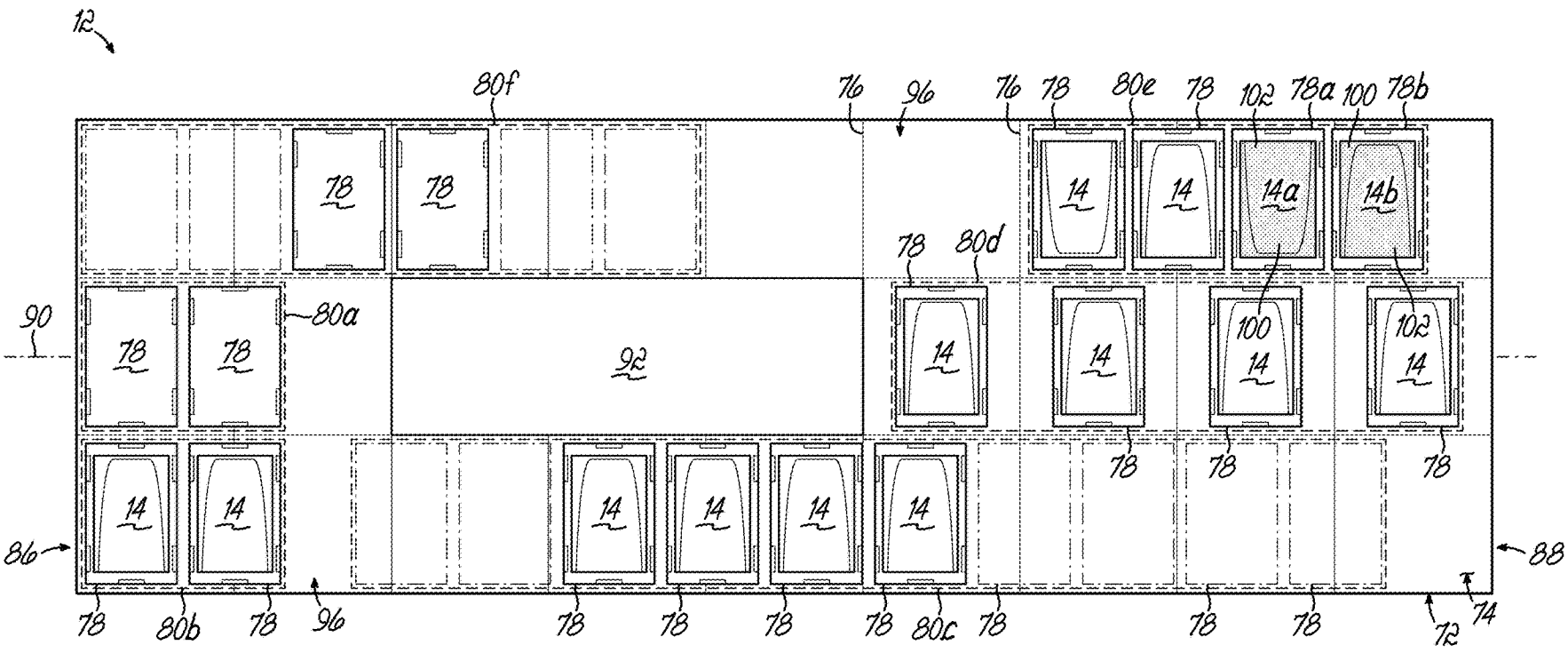
88
74
72
78b
100
78a
102
78
80e
78
76
96
76
80d
78
78
102
14
14b
14a
100
14
14
14

APPARATUS AND METHOD FOR ORIENTING POUCHES HEAD-TO-TOE

CROSS-REFERENCE TO RELATED APPLICATION

The present application claims the filing benefit of U.S. Provisional Application Ser. No. 63/499,832, filed May 3, 2023, the disclosure of which is incorporated herein by reference in its entirety.

TECHNICAL FIELD

This invention relates generally to a multi-pack pouch cartoning system having a horizontal form, fill, and seal machine and a cartoner machine, and more particularly, to an apparatus and method for transferring products from the horizontal form, fill, and seal machine to the cartoner machine.

BACKGROUND

In the packaging industry, horizontal form, fill, and seal (HFFS) machines are used to form and fill pouches or bags with a product, such as food, beverages, or pharmaceuticals. Once the pouches or bags are filled and sealed, they need to be transferred to a cartoner machine that forms, fills, and closes the cartons that will contain the pouches or bags for downstream use. A system that includes at least a HFFS machine and a cartoner machine may be referred to as a multi-pack pouch cartoning (MPPC) system. To this end, transferring product from the HFFS machine to the cartoner machine is critical to the efficiency and success of the overall operation of the MPPC system, as it must be carried out quickly and accurately to avoid downtime and waste.

Conventional product transfer systems are known in the art for transferring products from a HFFS machine to a cartoner machine. However, these conventional product transfer systems have several limitations that can cause problems in the packaging process. For example, the orientation of the products for downstream packaging is often inconsistent, and cannot be corrected without manual intervention, which can lead to inefficiencies within the system. Additionally, conventional product transfer systems don't always optimize packaging of filled pouches in a carton, especially when the pouches bulge at one end.

Moreover, conventional product transfer systems often lack the ability to monitor the fill weight of the products, which can result in under-filled or over-filled packages being transferred from the HFFS machine to the cartoner machine for packaging. This can lead to waste, product quality issues, or even regulatory compliance problems, which can be costly to address. In addition, conventional product transfer systems often do not provide a suitable accumulation buffer to handle system shutdown events, such as equipment malfunctions or power outages. As a result, when a shutdown event occurs, the product transfer system may require additional startup time to reaccumulate the product before the packaging operation can continue, which can result in additional unwanted downtime and lost productivity.

Finally, conventional product transfer systems often do not provide a means for changing the product pitch to match the requirements of the cartoner machine. This can result in a mismatch between the spacing of the products and the requirements of the cartoner machine, causing errors in the packaging process.

In view of the above, there is a need for an improved product transfer apparatus that can overcome these problems and improve the efficiency and effectiveness of the packaging process for a MPPC system, and in particular the transferring of product from the HFFS machine to the cartoner machine.

SUMMARY

The present invention overcomes the foregoing and other shortcomings and drawbacks of product transfer system that are used to transfer product from a product fill machine, such as a HFFS machine, to a bulk packaging machine, such as a cartoner machine. While the present invention will be discussed in connection with certain embodiments, it will be understood that the present invention is not limited to the specific embodiments described herein.

According to one embodiment of the present invention, a product transfer apparatus is provided. The product transfer apparatus includes an electromagnetic motor table configured to define a plurality of pre-selected zones and a plurality of moving elements configured to float over a surface of the electromagnetic motor table and move between one or more of the pre-selected zones. The product transfer apparatus further includes a product delivery device configured to deposit one or more products in a pre-selected common orientation, relative to a longitudinal axis of the product transfer apparatus, onto one or more moving elements of the plurality of moving elements, respectively, at a first pre-selected zone of the plurality of pre-selected zones such that each of the one or more moving elements receives a single product from the product delivery device in the pre-selected common orientation at the first pre-selected zone. The product transfer apparatus further includes a product picking device configured to pick a group of products constituted by one or more products from a pre-selected group of the plurality of moving elements at a second pre-selected zone of the plurality of pre-selected zones, wherein the orientation of one or more products of the group of products at the second pre-selected zone is different from the pre-selected common orientation of the products received at the first pre-selected zone, and deposit the one or more products of the group of products into at least one cartoner bucket of a cartoner.

According to one aspect of the present invention, wherein the first pre-selected zone may be defined as a load zone of the electromagnetic motor table which is located within a spatial reach of the product delivery device. In another aspect, the second pre-selected zone may be defined as a pick zone of the electromagnetic motor table which is located within a spatial reach of the product picking device.

According to another aspect of the present invention, the electromagnetic motor table may include a plurality of electromagnetic motor modules arranged in a predetermined planar layout. Furthermore, each of the moving elements may include a permanent magnet. In yet another aspect, each of the moving elements may be a shuttle configured to support and retain a single product thereon.

According to one aspect of the present invention, a third pre-selected zone of the plurality of pre-selected zones may be defined as a staging zone of the electromagnetic motor table. Additionally, the orientation of the one or more products may be selectively changed by rotating one or more of the pre-selected group of moving elements so that one or more products at the staging zone is oriented 180° relative to one or more other products at the staging zone.

According to yet another aspect of the present invention, the electromagnetic motor table may be configured to define a loading queue independent of the plurality of pre-selected zones defined by the electromagnetic motor table which is located at one end operationally adjacent to the load zone of the product transfer apparatus. Furthermore, the electromagnetic motor table may be configured to define a picking queue independent of the plurality of pre-selected zones defined by the electromagnetic motor table which is located at one end operationally adjacent to the load zone of the product transfer apparatus and at an opposite end operationally adjacent to the staging zone of the product transfer apparatus.

According to one embodiment of the present invention, the product delivery device may comprise a rotatable picking arm and the product picking device may comprise a delta robot.

According to another embodiment of the present invention, the electromagnetic motor table may be configured to define a plurality of discrete slots. Each slot may define a pre-selected position of one moving element of the plurality of moving elements at an instant in time. Furthermore, each pre-selected zone of the plurality of pre-selected zones may be defined by one or more slots of the plurality of slots. Additionally, each of the electromagnetic motor modules may include at least one slot of the plurality of discrete slots.

According to another embodiment of the present invention, a multi-pack pouch cartoning system is provided. The multi-pack pouch cartoning system includes a horizontal form, fill and seal machine configured to form, fill and seal one or more individual pouches, a pouch transfer apparatus, and a cartoner machine including at least one cartoner bucket. The pouch transfer apparatus includes an electromagnetic motor table configured to define a plurality of pre-selected zones and a plurality of moving elements configured to float over a surface of the electromagnetic motor table and move between one or more of the pre-selected zones. The product transfer apparatus further includes a pouch delivery device operatively connected to the horizontal form, fill and seal machine and configured to receive the individual pouches from the horizontal form, fill and seal machine and deposit one or more of the individual pouches in a pre-selected common orientation, relative to a longitudinal axis of the pouch transfer apparatus, onto one or more moving elements of the plurality of moving elements, respectively, at a first pre-selected zone of the plurality of pre-selected zones such that each of the one or more moving elements receives a single pouch from the pouch delivery device in the pre-selected common orientation at the first pre-selected zone. The product transfer apparatus further includes a pouch picking device configured to pick a group of pouches constituted by one or more pouches from a pre-selected group of the plurality of moving elements at a second pre-selected zone of the plurality of pre-selected zones, wherein the orientation of one or more pouches of the group of pouches at the second pre-selected zone is different from the pre-selected common orientation of the pouches received at the first pre-selected zone.

According to one aspect of the present invention, the orientation of the one or more pouches may be selectively changed by rotating one or more of the pre-selected group of moving elements so that one or more pouches at the second pre-selected zone is oriented 180° relative to one or more other pouches at the second pre-selected zone. According to another aspect, the pouch delivery device may include a rotatable picking arm and the pouch picking device may include a delta robot.

According to another embodiment of the present invention, a method of cartoning a plurality of pouches in a carton is disclosed. The method includes forming, filling and sealing one or more pouches in a horizontal form, fill and seal machine and receiving the pouches in a pre-selected common orientation on one or more moving elements of a pouch transfer apparatus at a first pre-selected zone of the pouch transfer apparatus such that each of the one or more moving elements receives a single pouch in the pre-selected common orientation at the first pre-selected zone. The method further includes picking a group of pouches constituted by one or more pouches from a pre-selected group of the moving elements at a second pre-selected zone of the pouch transfer apparatus, wherein the orientation of one more pouches of the group of pouches at the second pre-selected zone is different from the common orientation of the pouches received at the first pre-selected zone, depositing one or more of the picked pouches into at least one cartoner bucket of a cartoner, and cartoning one or more of the deposited pouches into a carton.

According to one aspect of the present invention, the method may further include rotating one or more of the moving elements between the first pre-selected zone and the second pre-selected zone so that one or more of the pouches at the second pre-selected zone is oriented 180° relative to one or more other pouches at the second pre-selected zone. According to another aspect, the moving elements may float over a surface of an electromagnetic table of the pouch transfer apparatus as the moving elements move from the first pre-selected zone to the second pre-selected zone.

According to yet another aspect of the present invention, the method may include the step of depositing one or more pouches in the pre-selected common orientation from the horizontal form, fill and seal machine to the pouch transfer apparatus via a pouch delivery device comprising a rotatable picking arm operatively connected to the horizontal form, fill and seal machine and located within a spatial reach of the first pre-selected zone. In yet another aspect, the picking step may be performed by a pouch picking device comprising a delta robot located within a spatial reach of the second pre-selected zone.

According to one aspect of the present invention, the method may further include the step of determining a pouch weight of each pouch received the on one or more moving elements at the first pre-selected zone is outside a pre-determined weight range for the pouches. Furthermore, if the pouch weight is outside the pre-determined weight range, the method may include the step of moving the pouch to a third pre-selected zone for disposal or rework. In yet another aspect, if one or more of the moving elements does not receive one pouch, the one or more of the moving elements that did not receive one pouch may remain in the first pre-selected zone.

Various additional features and advantages of the invention will become more apparent to those of ordinary skill in the art upon review of the following detailed description of one or more illustrative embodiments taken in conjunction with the accompanying drawings.

BRIEF DESCRIPTION OF THE DRAWINGS

The accompanying drawings, which are incorporated in and constitute a part of this specification, illustrate one or more embodiments of the invention and, together with the general description given above and the detailed description given below, serve to explain the one or more embodiments of the invention.

FIG. 10B is a schematic top view of the perspective view of the table shown in FIG. 10A, illustrating a position of each moving element about the table at that instant in time.

DETAILED DESCRIPTION

Aspects of the present invention are directed to a pouch transfer apparatus for use in a MPPC system. In particular, the pouch transfer apparatus is configured to receive finished product from a HFFS machine, such as one or more filled and sealed pouches, and transfer the finished product to a cartoner machine for bulk packaging. As will be described in further detail below, the pouch transfer apparatus includes a fleet of individual moving elements configured to receive the finished product from the HFFS machine. In particular, the moving elements are operated to transfer the product from the HFFS machine to the cartoner machine in an organized manner so that the finished product may be picked from the pouch transfer apparatus and placed into respective cartoner buckets for bulk packaging. In that regard, during the transfer process, the fleet of moving elements move in a coordinated manner to deliver product to the cartoner for further packaging. The moving elements are configured to orient the product in a desired orientation for packaging and with the appropriate product pitch to match the requirements of the cartoner buckets of the cartoner machine. The moving elements are further capable of detecting the quality of the product being received from the HFFS machine, such as by detecting a fill weight of the product. If product is determined to be rejected, due to being underfilled or overfilled, the moving elements are configured to remove the product from the product flow, such as by delivering to product to a reject area for disposal. Typically, removing of one or more products from the product flow path results in a hole or gap in the product flow due to the missing rejected product. However, the product transfer apparatus of the present invention is configured for hole healing such that any hole created by a rejected product is closed so as not to create any packaging or product waste downstream due to an underfilled carton, for example. These and other benefits of the present invention will be described in further detail below.

Figure 1:
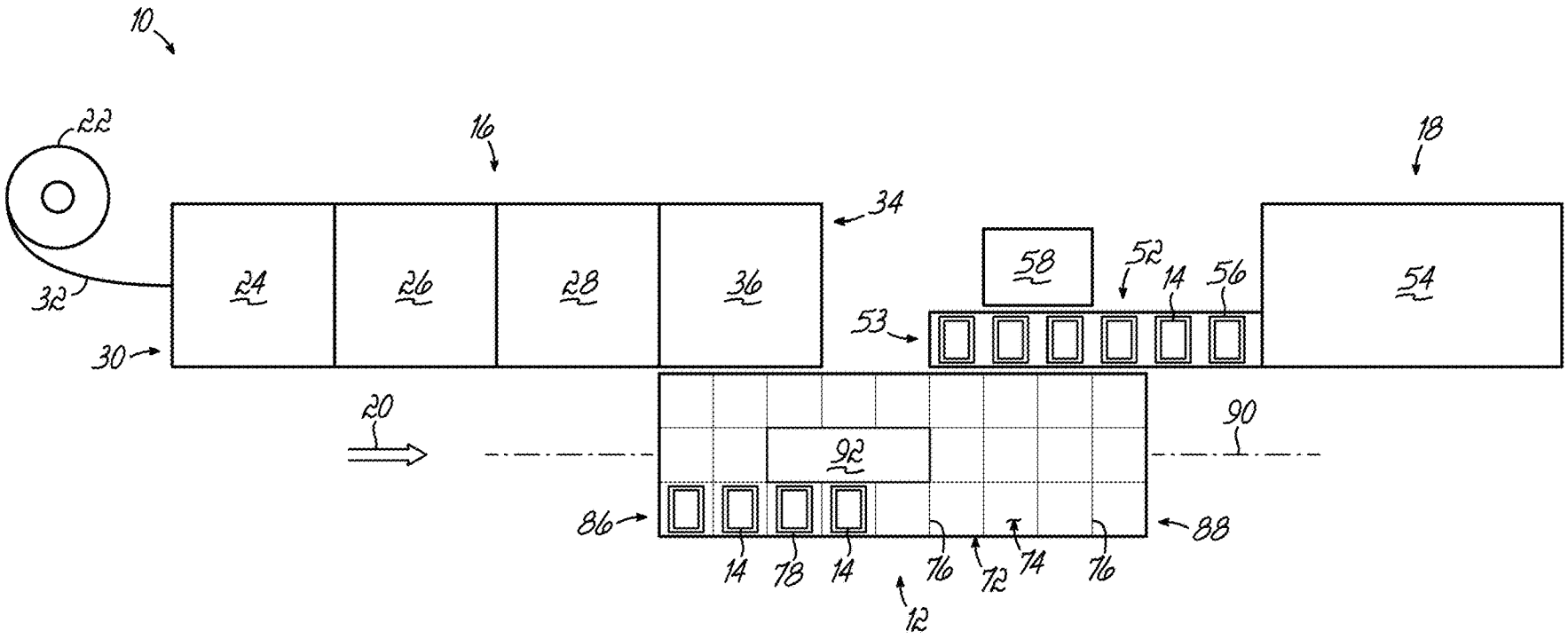
FIG. 1 is a diagrammatic view of a multi-pack pouch cartoning system having a product transfer apparatus for transferring pouches from an HFFS machine to a cartoner according to one embodiment of the invention.

Referring now to the figures, FIG. 1 illustrates an exemplary multi-pack pouch cartoning (MPPC) system 10 in which a pouch transfer apparatus 12 according to embodiments of the invention has particular utility. The MPPC system 10 is configured to form, fill and seal multiple pouches 14 (e.g., FIG. 1A) with product and further package one or more of the pouches 14 into a single carton for distribution. In that regard, the MPPC system 10 includes a horizontal form, fill and seal (HFFS) machine 16 that forms, fills and seals individual pouches 14 with product and a cartoner machine 18 that packages one or more filled pouches 14 (otherwise referred to as finished pouches) into a single carton for distribution. In that regard, product moves through the MPPC system 10 in a product movement direction 20, beginning with the HFFS machine 16 where raw materials are brought together to form individual pouches, fill the pouches with a product, seal the filled pouches, and deliver the finished pouches 14 to the product transfer apparatus 12. The product transfer apparatus 12 transfers the finished pouches 14 to the cartoner machine 18 for bulk packaging, as will be described in further detail below. To this end, the product transfer apparatus 12 is located along the product movement path 20 at a location that is downstream of the HFFS machine 16 and upstream of the cartoner machine 18.

With continued reference to FIG. 1, the HFFS machine 16 is configured to form individual pouches or bags from a flat roll of film 22 or other flexible packaging materials. In that regard, the exemplary HFFS machine 16 includes components that work together to create, fill, and seal individual pouches 14. For example, the HFFS machine 16 may include a forming and cutting station 24, a filling station 26 and a sealing station 28. As shown, the forming and cutting station 24 is located at an infeed end 30 of the HFFS machine 16 and is configured to receive a continuous film web 32, often referred to as a bandelier, from the roll of film 22. The forming and cutting station 24 includes various forming tools and mechanisms to shape and size the film web 32 into pouches, followed by cutting the film web 32 into individual pouches. This process results in a continuous flow of individual pouches that are ready for filling and sealing. Typically, the individual pouches are sealed on three sides, leaving an open top. The open top allows the pouch to be filled with the desired product before the final sealing process, which completes the pouch and prepares it for further processing or packaging.

The individual pouches move from the forming and cutting station 24 to the filling station 26 of the HFFS machine 16 where the pouches are filled with a volume of product. The pouches may be filled using volumetric or weight-based dosing systems, for example. From the filling station 26, the filled pouches are advanced to the sealing station 28 where the open top of each pouch is sealed closed. The pouches may be sealed using heat, ultrasonic or other sealing technologies. For example, the sealing station 28 may include one or more horizontal sealing devices for sealing closed the open top of each pouch. Each filled and sealed pouch (referred to hereinafter as a pouch) 14 is moved in a direction along the product movement path 20 toward an outfeed end 34 of the HFFS machine 16 where a product delivery device 36 is located.

Figure 1A:
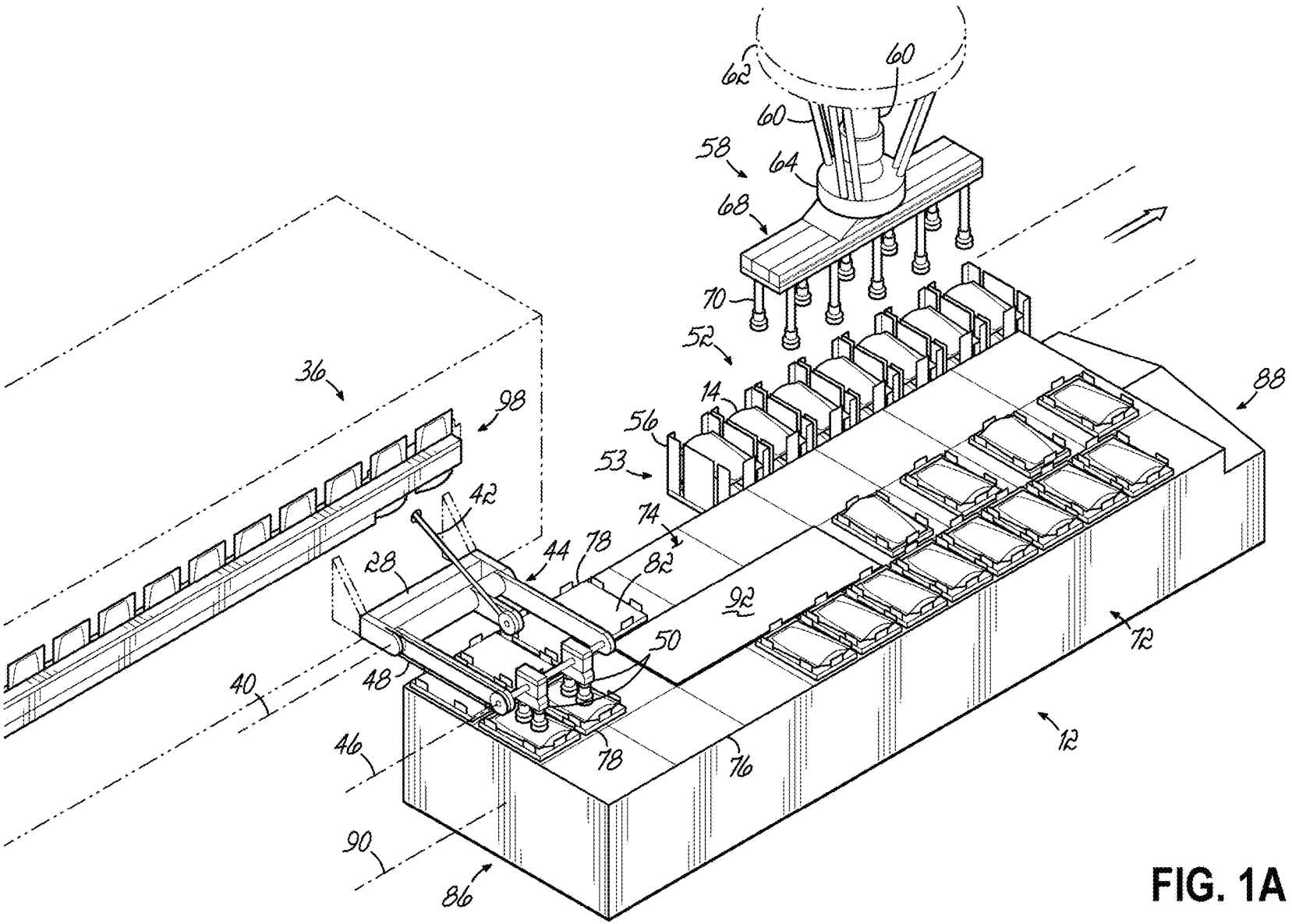
FIG. 1A is a perspective view of the product transfer apparatus, illustrating a product delivery device of the HFFS machine depositing two pouches onto a table of the product transfer apparatus.

The product delivery device 36 is configured to transfer pouches 14 from the HFFS machine 16 to the product transfer apparatus 12. As best shown in FIG. 1A, the product delivery device 36 includes a body 38 that is rotatable about a first rotational axis 40 by an actuator arm 42. The body 38 of the product delivery device 36 includes a rotatable picking arm 44 which rotates relative to the body 38 about a second rotational axis 46. Rotational movement of the rotatable picking arm 44 may be powered by a belt drive 48, as shown. The rotatable picking arm 44 includes a pair of end effectors 50 which are used to hold a respective pouch 14 during movement of the product delivery device 36. In that regard, one cycle of the product delivery device 36 results in two pouches 14 being deposited from the HFFS machine 16 onto the product transfer apparatus 12. To this end, each end effector 50 may comprise a suction cup configured to create a vacuum between the suction cup and surfaces of a pouch 14 to hold the pouch 14 against the suction cup during movement of the product delivery device 36.

The HFFS machine 16 may be an intermittent motion or continuous motion machine, for example. The exemplary HFFS machine 16 may be an SI 280 machine commercially available from VOLPAK (Barcelona, Spain), capable of forming, filling, and sealing up to 240 pouches-per-minute (ppm). To this end, it will be understood that the HFFS machine 16 may include additional components that are known to a person of ordinary skill in the art, such as film splicing units, sensors for detecting film and product presence, and registration systems for accurate pouch positioning. To this end, the exemplary HFFS machine 16 is not intended to limit the scope of the invention.

With reference to FIGS. 1 and 1A, the cartoner machine 18 is configured to erect, fill, and close cartons or boxes. In particular, the cartoner machine 18 cartons or fills the erected cartons with one or more pouches 14 received from the product transfer apparatus 12. In that regard, the cartoner machine 18 may include a product infeed device 52 that feeds a cartoning station 54 with pouches 14. The product infeed device 52 may include one or more cartoner buckets 56 configured to receive one or more pouches 14 picked or removed from the product transfer apparatus 12 by a product picking device 58. The one or more cartoner buckets 56 may be attached to a continuous belt that is driven by a motor to move cartoner buckets 56 that have been filled with one or more pouches 14 in a direction along the product movement path 20 toward the cartoning station 54 where the one or more pouches 14 are moved from the cartoner buckets 56 into erect cartons. To this end, the continuous belt cycles the emptied cartoner buckets 56 back a loading end 53 of the product infeed device 52 that is adjacent to the product transfer apparatus 12 where the empty cartoner buckets 56 are refilled with one or more pouches 14. However, the invention is not limited to placement of pouches 14 into cartoner buckets 56. In an alternative embodiment, the product delivery device 58 may be configured to place pouches 14 directly into a package, case, carton, tray, or any other type of container, for example.

While not shown, the cartoning station 54 of the cartoner machine 18 includes components that work together to erect, fill, and close cartons or boxes, such as at least an erecting mechanism, a loading or cartoning mechanism, a closing mechanism, and a discharge device. In that regard, the erecting mechanism erects the carton blanks into the desired shape, which can be a tray, a box, or a tube, for example. The loading mechanism transfers the one or more pouches from a corresponding cartoner bucket into the erected carton. Once the carton has been filled with one or more pouches 14, the closing mechanism folds and seals the carton flaps using glue, tape, or mechanical locks, for example. The discharge device, which may be a conveyor, transfers the finished cartons out of the cartoner machine for further processing or packaging. The exemplary cartoner machine 18 may be a CIM 100 cartoner machine, commercially available from the Assignee of the present invention. To this end, it will be understood that the cartoner machine 18 may include additional components that are known to a person of ordinary skill in the art, such as a carton feeder, devices for coding, marking, or labeling the cartons or products, and inspection systems for quality control, for example. To this end, the exemplary cartoner machine 18 is not intended to limit the scope of the disclosure.

As briefly described above, the product picking device 58 is configured to move pouches 14 from the product transfer apparatus 21 to the cartoner machine 18. In particular, the product picking device 58 is configured to pick pouches 14 from the product transfer apparatus 12 and place the pouches 14 into one or more cartoner buckets 56 of the product infeed device 52. In the exemplary embodiment shown, the product picking device 58 is a parallel robot, such as a delta robot. However, the product picking device 58 may be any type of robotic manipulator or robotic arm capable of picking pouches 14 from the product transfer apparatus 12 and placing the pouches 14 in another location, such as a cartesian manipulator, cylindrical manipulator, spherical manipulator, articulated manipulator or a delta manipulator, for example.

With continued reference to FIGS. 1 and 1A, the product picking device 58 includes a plurality of movable arms 60 that are arranged in parallel pairs and connected between a support frame 62 and a head 64 of the product picking device 58. The plurality of arms 60 are arranged in a triangular pattern, and each arm 60 may include one or more links or segments that are connected by joints or hinges, for example. Each arm 60 of the product picking device 58 may be actuated by its own actuator, or alternatively, a single actuator 66 may be used to move all arms 60 together and move the head 64 of the product picking device 58. Attached to the head 64 of the product picking device 58 is an end-of-arm tool (EOAT) 68 that includes several pairs of end effectors 70. In the embodiment shown, the EOAT 68 includes five pairs of end effectors 70 that are spaced equally apart along a length of the EOAT 68. Each end effector 70 may include a suction cup configured to create a vacuum between the suction cup and surfaces of a pouch 14 to hold the pouch 14 against the suction cup during movement of the product picking device 58 and the pouch 14.

The MPPC system 10 may include one or more control panels where appropriate control equipment (i.e., one or more controllers) for components of the fryer MPPC system 10 are located. While Human Machine Interfaces (HMI) may be located on specific equipment, the control panel(s) may be where one or more HMIs and programmable logic controllers (PLC) are located, for example. To this end, according to embodiments of the present invention, components of the MPPC system 10 are responsive to stored programs for commanding operation of those components. The programs may be computer-readable program instructions for carrying out operations in accordance with the embodiments of the present invention. The computer-readable programs may be assembly language, source code, or object code written in any combination of one or more programming languages, and may be implemented using one or more computing devices or systems which may include a processor, a memory, an input/output (I/O) interface, and a Human Machine Interface (HMI), for example.

Referring now to FIGS. 1 and 1A, the product transfer apparatus 12 will be further described, including the process of transferring pouches 14 from the HFFS machine 16 onto the product transfer apparatus 12, and subsequently transferring the pouches 14 from the product transfer apparatus 12 to the cartoner machine 18. As shown, the product transfer apparatus 12 includes an electromagnetic motor table ("table") 72 that defines a planar transfer surface 74. In particular, the planar transfer surface 74 is defined by a plurality of electromagnetic motor modules ("modules") 76 arranged on the table 72. The product transfer apparatus 12 further includes a plurality of moving elements 78 that are configured to float over the transfer surface 74 of the table 72 to move product or pouches 14 in an organized manner about the table 72. Each moving element 78 may comprise a shuttle sized to receive a single pouch 14, for example. Specifically, the table defines a plurality of pre-selected zones 80*a*-80*f* on the transfer surface 74 between which the plurality of moving elements 78 are configured to move, as will be described in further detail below.

As briefly described above, the moving elements, referred to hereinafter as shuttles 78, are designed to float above the transfer surface 74 of the table 72 so as to move between the pre-selected zones 80*a*-80*f* and about the table 72 in a contactless manner. That is, the shuttles 78 do not contact the transfer surface 74 as they move about the table 72. Instead, the shuttles 78 are levitated above the transfer surface 74 using magnetic levitation technology. Each shuttle 78 includes a shuttle body 82 that includes one or more sidewall tabs that surround a pouch receiving space atop the shuttle body. Furthermore, the shuttle body houses a permanent magnet that interacts with the electromagnetic motor modules 76, which enables the shuttle 78 to float or levitate above the transfer surface 74. Electricity or current can be applied to the electromagnetic motor modules 76 in a predetermined manner to induce motion in the shuttles 78, causing them to move across the transfer surface 74 and around the table 72 as desired. Specifically, shuttle 78 levitation is achieved through the interaction of a shuttle's 78 permanent magnet with the electromagnetic motor modules 76, which produces a magnetic field gradient that results in a restoring force that maintains the shuttle's 78 stable levitation above the transfer surface 74. As a result, each shuttle 78 can move freely in two-dimensional space around the table 72. Furthermore, a height of levitation for each shuttle 78 can be precisely controlled. This means that the shuttles 78 can be moved in three movement axes (X, Y, Z) relative to the transfer surface 74 of the table 72. Furthermore, the shuttles 78 are also capable of rotating and tilting along the three movement axes (X, Y, Z), which gives each shuttle 78 six degrees of motion control freedom. In summary, the shuttles 78 are configured to move freely and accurately in multiple dimensions. To this end, each shuttle 78 may carry a payload of up to 14 kilograms and reach speeds of up to 2 meters per second, for example. The electromagnetic motor modules 76 and shuttles 78 may be the ACOPOS 6D system that is commercially available from B&R Industrial Automation GmbH (Roswell, Georgia (US)). The electromagnetic motor modules 76 and shuttles 78 are further described in U.S. Pat. No. 9,202,719 to The University of British Columbia, Vancouver (CA), the contents of which are herein incorporated by reference in their entirety.

With continued reference to FIGS. 1 and 1A, the table 72 of the product transfer apparatus 12 is elongate and extends from a first, loading end 86 to an opposite, picking end 88 to define a longitudinal axis of the table 90. As shown, the loading end 86 of the product transfer apparatus 12 is arranged adjacent to the product delivery device 36 and is where pouches 14 are received onto the product transfer apparatus 12 from the HFFS machine 16. The picking end 88 of the product transfer apparatus 12 is arranged adjacent to the product picking device 58 and is where pouches 14 are removed from the product transfer apparatus 12 for packaging. As shown, the longitudinal axis 90 of the table 72 of the product transfer apparatus 12 extends substantially parallel to the product movement direction 20 of the MPPC system 10. In the embodiment shown, the table 72, and particularly the transfer surface 74, is generally rectangular in shape. However, other polygonal shapes of the table 72 and the transfer surface 74 are possible, such as a square, for example.

Figure 1B:
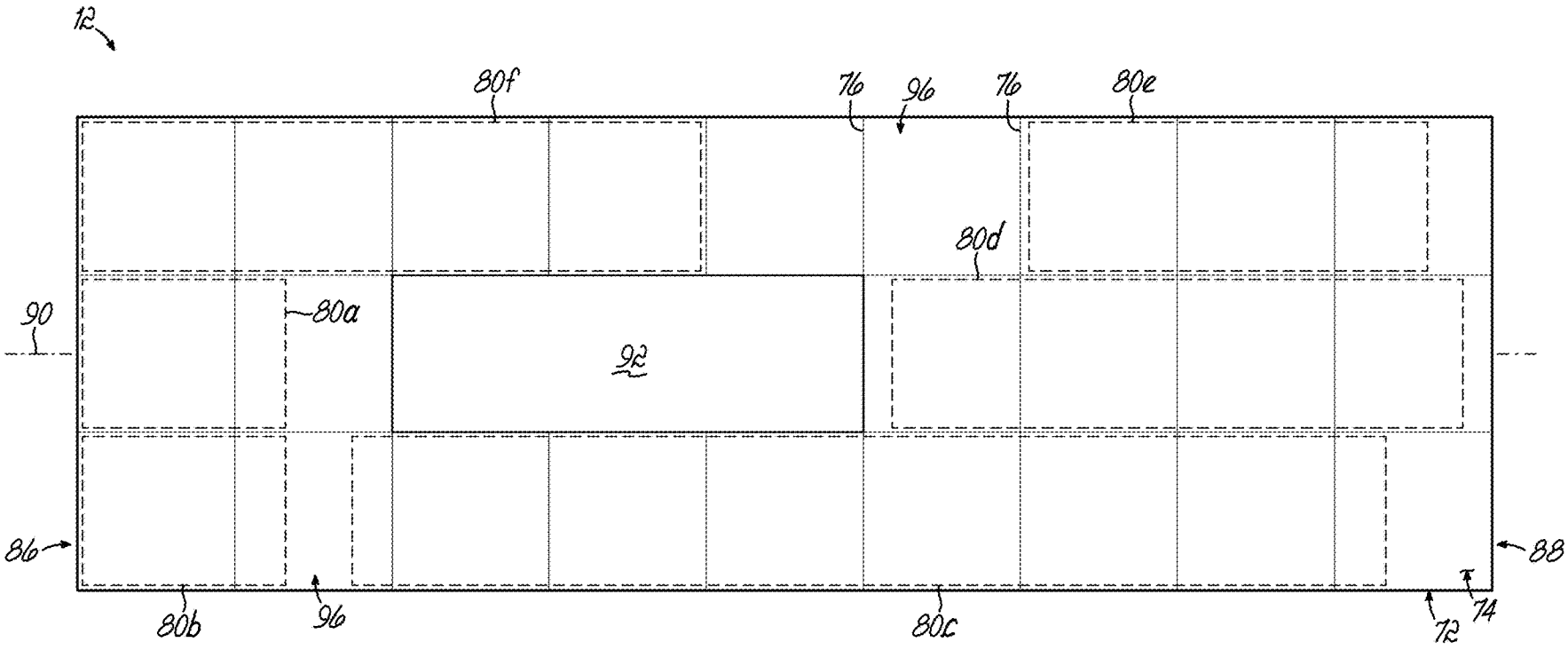
FIG. 1B is a schematic top view of the table of the product transfer apparatus, illustrating one or more pre-selected zones between which a plurality of moving elements are configured to move about the table.
Figure 1C:
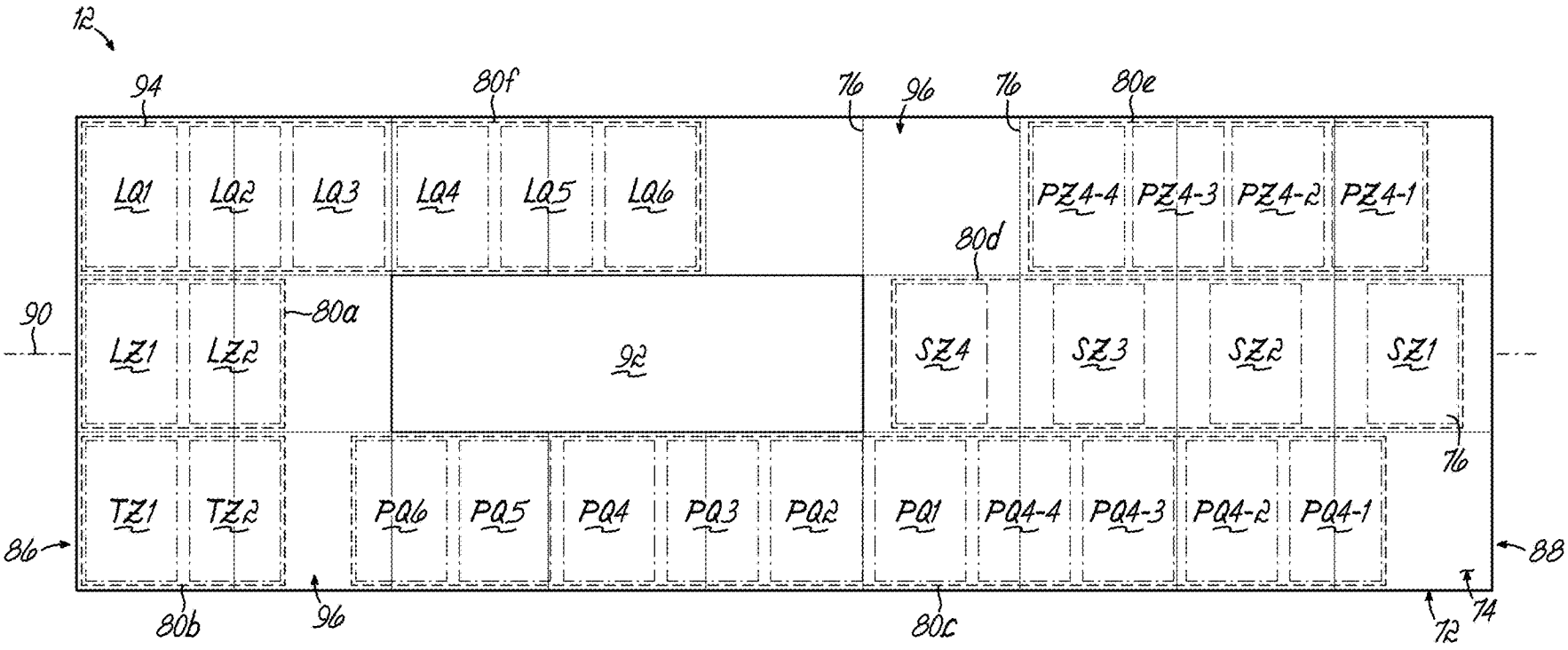
FIG. 1C is a view similar to FIG. 1B, illustrating a plurality of discrete slots of each pre-selected zone, the slots representing a predetermined location of one of the plurality of moving elements at an instant in time.

Referring now to FIGS. 1-1C, the table 72 of the product transfer apparatus 12 includes the transfer surface 74 which is defined by the plurality of electromagnetic motor modules 76. The electronic motor modules 76 are generally flat square units that resemble tiles arranged adjacent to each other about the table 72. As the electromagnetic motor modules 76 effectuate movement of the shuttles 78, the shuttles 78 may only be configured to move about the table 72 where electromagnetic motor modules 76 are placed. Thus, the transfer surface 74 is defined by the electromagnetic motor modules 76. However, as shown in e.g., FIG. 1B, the table 72 may include one or more voids or unused space 92 where no electromagnetic motor modules 76 are located.

With continued reference to FIGS. 1-1C, the table 72 includes a plurality of pre-selected zones 80*a*-80*f* between which the plurality of shuttles 78 are configured to move. In particular, the table 72 includes a load zone 80*a*, a transient zone 80*b*, a picking queue 80*c*, a staging zone 80*d*, a pick zone 80*e*, and a loading queue 80*f*. As shown, each pre-selected zone 80*a*-80*f* is an independent pre-defined region on the transfer surface 74 that includes one or more of the electromagnetic motor modules 76. The shuttles 78 are configured to move between adjacent pre-selected zones 80*a*-80*f* as they move about the table 72. In particular, as the shuttles 78 move between zones 80*a*-80*f*, from the loading end 86 to the picking end 88 of the table 72 and back to the loading end 86, each shuttle 78 can be programmed to stay within each pre-selected zone 80*a*-80*f* for a specific duration or execute specific movements within each zone 80*a*-80*f*, as will be described in further detail below.

As best shown in FIG. 1C, each of the plurality of pre-selected zones 80*a*-80*f* includes a plurality of discrete slots. That is, each of the pre-selected zones 80*a*-80*f* is defined by one or more of the plurality of discrete slots. Further, each of the electromagnetic motor modules 76 may include at least one of the plurality of discrete slots. Each slot may be similarly sized and is configured to accommodate the size and shape of a single shuttle 78, and it represents a possible pre-selected position of one of the shuttles 78 on the table 72 at an instant in time. For example, not every slot may be filled with a shuttle 78 to provide extra "buffer" slots for buffering within the system. In any event, the shuttles 78 move across the table 72 by transitioning from one slot in a particular zone 80*a*-80*f* to another slot in an adjacent zone 80*a*-80*f*. Depending on the operating speed of the system 10, a shuttle 78 can pause within a slot for a predetermined period of time. In order to avoid unintended contact between shuttles 78, for example, the pre-selected zones 80*a*-80*f* and discrete slots are positioned at a distance from each other to create buffer space 96 between therebetween on the transfer surface 74 of the table 72. The buffer space 96 is most noticeable spacing of the pre-selected zones 80*a*-80*f* and discrete slots in the longitudinal (i.e., along the longitudinal axis 90 of the table 72), but buffer space 90 also exists in the widthwise spacing of the pre-selected zones 80*a*-80*f* and discrete slots. In other words, the buffer space 96 is present both in the direction of the longitudinal axis 90 (i.e., length) of the table 72 and in the direction of its transverse width. This ensures that there is adequate distance between the shuttles 78, not only when they move in a lengthwise direction along the longitudinal axis 90 of the table 72, but also when they move transversely along the widthwise direction of the table 72.

With continued reference to FIG. 1C, each shuttle 78 is configured to move in a counter-clockwise direction about the table 72 and between zones 80*a*-80*f*. Specifically, each shuttle 78 moves through the pre-selected zones 80*a*-80*f* in the following sequence to complete a single transit around the table: load zone 80*a*→transient zone 80*b*→picking queue 80*c*→staging zone 80*d*→pick zone 80*e*→loading queue 80*f*, and back to the load zone 80*a*. As shown in FIG. 1C, the load zone 80*a* is adjacent to the loading end 86 of the table 72 and includes two discrete slots, LZ1 and LZ2, arranged adjacent to one another. In that regard, two shuttles 78 are configured to be located in the load zone 80*a* at a time, in slots LZ1 and LZ2, respectively, to receive pouches 14 from the product delivery device 36, as will be described in further detail below. From the load zone 80*a*, the two shuttles 78 move to the transient zone 80*b*. In that regard, the transient zone 80*b* is operationally adjacent to the load zone 80*a*. By operationally adjacent, it is meant that a next movement of a shuttle 78 out of one zone 80*a*-80*f* is to the zone 80*a*-80*f* that is immediately adjacent to it in terms of the operation of the system. In other words, the shuttle 78 moves from one zone 80*a*-80*f* to the adjacent zone 80*a*-80*f* in a sequence that corresponds to the operational flow of the shuttles 78, rather than being based on physical proximity or distance. For example, the transient zone 80*b* is operationally adjacent to the load zone 80*a* because a next movement of a shuttle 78 from the load zone 80*a* is to the transient zone 80*b*. To this end, the term operationally adjacent is used to describe the movement of shuttles 78 between zones 80*a*-80*f*. Like the load zone 80*a*, the transient zone 80*b* is adjacent to the loading end 86 of the table and includes two discrete slots, being TZ1 and TZ2, for receiving two shuttles 78.

With continued reference to FIG. 1C, the picking queue 80*c* is operationally adjacent to the transient zone 80*b* and includes ten discrete slots, being PQ1 through PQ6 and PQ4-1 through PQ4-4, for receiving ten shuttles 78. As will be described in further detail below, slots PQ1-PQ6 form a queue of shuttles 78 that are received from the transient zone 80*b*. Shuttles 78 are then advanced within the picking queue 80*c* into slots PQ4-1 to PQ4-4. To this end, shuttles 78 are advanced within the picking queue 80*c* in a direction along the longitudinal axis 90 of the table 72 toward the staging zone 80*d*. The staging zone 80*d* is located at the picking end 88 of the table 72 and is operationally adjacent to the picking queue 80*c*. As shown, the staging zone 80*d* includes four discrete slots, being SZ1-SZ4, for receiving four shuttles 78. Notably, there is a greater amount of buffer space 96 between each of the slots SZ1-SZ4 in the staging zone 80*d*. As will be described in further detail below, one or more of the shuttles 78 positioned in the staging zone 80*d* are rotated while in the staging zone 80*d* to reorient the shuttle 78 and corresponding pouch 78 to have a desired orientation for packaging. To this end, the additional buffer space 96 allows for the shuttles 78 to rotate within the staging zone 80*d*. The shuttles 78 move from the staging zone 80*d* to the pick zone 80*e* where each pouch 14 is removed or picked from each shuttle 78 by the product picking device 58. The pick zone 80*e* is operationally adjacent to the staging zone 80*d* and includes four discrete slots, being PZ4-1 through PZ4-4, for receiving four shuttles 78.

The loading queue 80*f* is operationally adjacent to the pick zone 80*e* and emptied shuttles 78 move from the pick zone 80*e* to the loading queue 80*f*. That is, once each pouch 14 has been picked from each shuttle 78 in the pick zone 80*e*, the empty shuttles 78 move from the pick zone 80*e* to the loading queue 80*f*. As shown, a large buffer space 96 (otherwise referred to as a transient space) may be located between the pick zone 80*e* and the loading queue 80*f* to provide space for additional buffering or a larger pick zone 80*e* or loading queue 80*f*, for example. The loading queue 80*f* is adjacent to the loading end 86 of the table 72 and includes six discrete slots, being LQ1-LQ6, for receiving six shuttles 78. The loading queue 80*f* feeds the load zone 70*a* and shuttles 78 may be advanced in pairs of two from the loading queue 80*f* to the load zone 80*a*, where they are resupplied with a pouch 14. After this resupply, the shuttles 78 repeat another transit around the table, as described above.

Having now described certain details of the product transfer apparatus 12, a method of transferring pouches from the HFFS machine 16 to the cartoner machine 18 using the product transfer apparatus 12 will now be described with reference to FIGS. 1A-12F in accordance with one embodiment of the invention. The method will be described with a particular focus on the movement of two exemplary shuttles 78*a*, 78*b* through the system. Specifically, one transit of the pair of shuttles 78*a*, 78*b* around the table 72 will be described. In the exemplary embodiment shown, the product transfer apparatus 12 is configured for a 4-count operation for an 8-count carton load, meaning that the product picking device is configured to simultaneously pick four pouches at a time from four shuttles 78 located in the pick zone 80*e*. However, as will be described in further detail below, where relevant, the product transfer apparatus 12 may be configured for different n-count operations, such as a 2-count or 3-count operation, for example. To this end, the count configuration of the system is dictated by the carton load requirements.

Figure 2A:
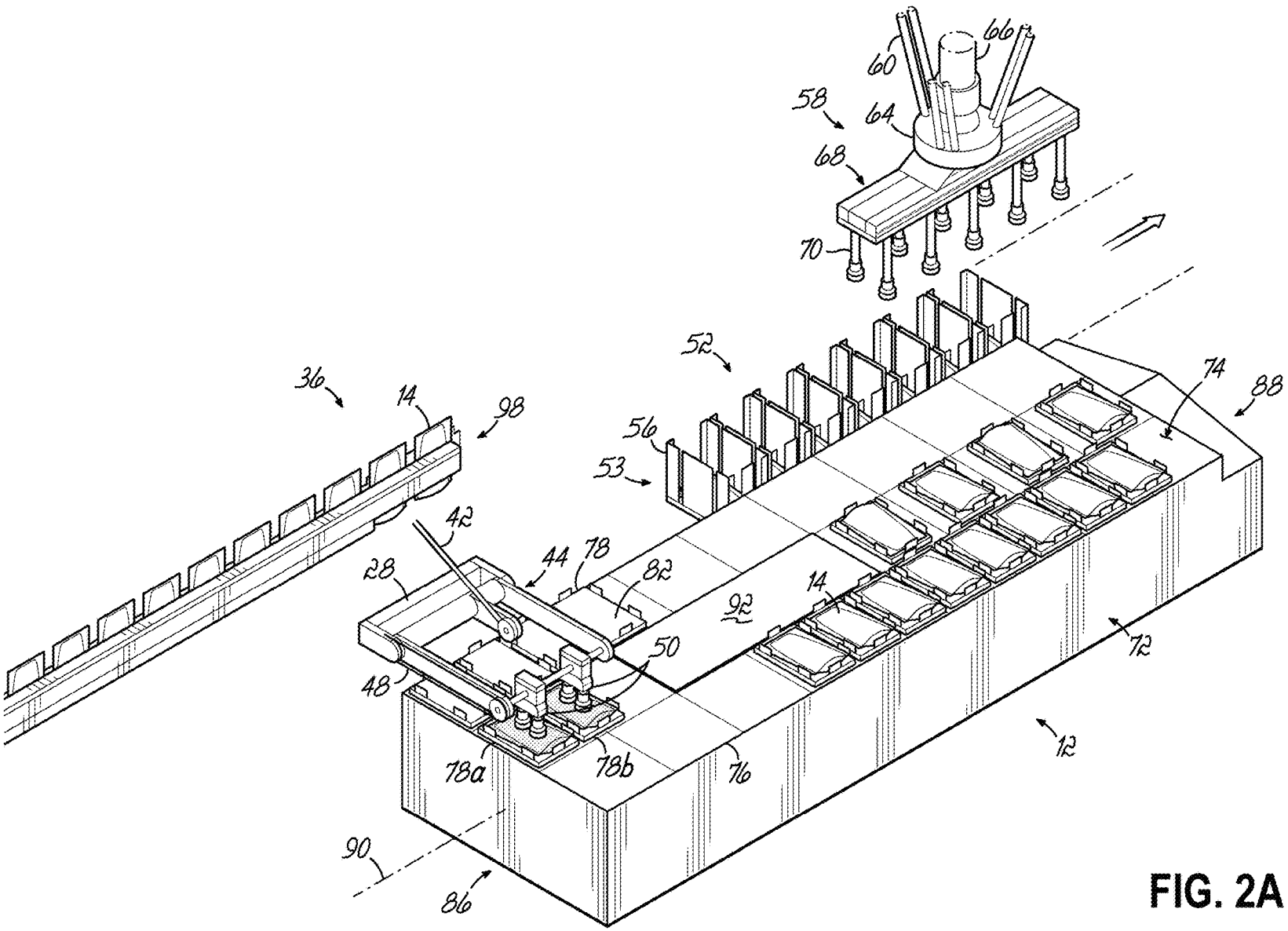
FIG. 2A is a perspective view of the product transfer apparatus, illustrating a product delivery device of the HFFS machine depositing pouches onto two moving elements positioned in a load zone.
Figure 2B:
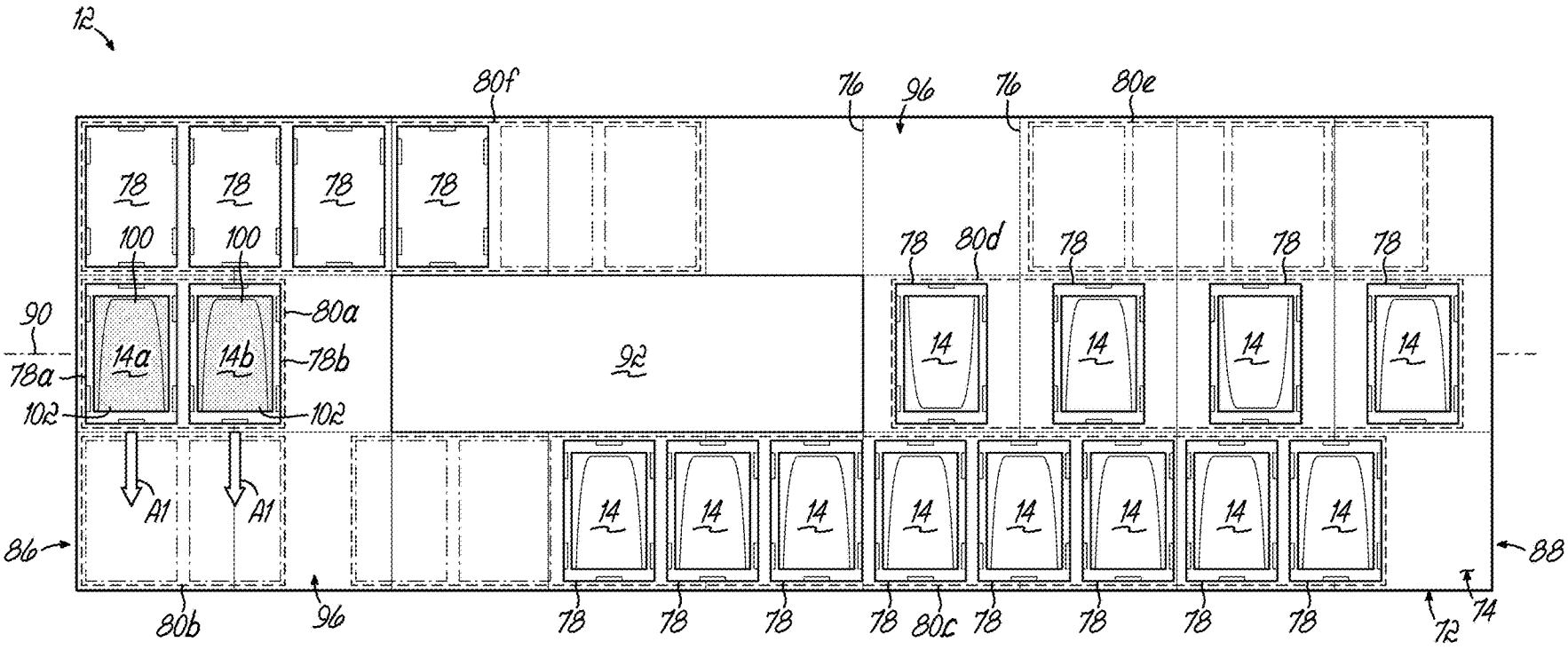
FIG. 2B is a schematic top view of the perspective view of the table shown in FIG. 2A, illustrating a position of each moving element about the table at that instant in time.

Referring now to FIGS. 1A, 2A and 2B the HFFS machine 16 forms, fills and seals individual pouches 14 as described above. As shown, the pouches 14 are advanced from the sealing station 28 to the pouch delivery device 36 in a pouch queue 98. Two pouches 14 are presented at the end of the pouch queue 98 to be picked by the product delivery device 36. In that regard, the product delivery device 36 moves to a pick position (e.g., FIG. 8A) to retrieve or pick the two pouches 14 positioned at the end of the pouch queue 98 with the end effectors 50. The product delivery device 36 simultaneously picks the two pouches 14 and then moves to a delivery position (e.g., FIG. 2A) to deposit the two picked pouches 14 onto respective shuttles 78 parked in the load zone 80*a*. Both the body 38 and the rotatable picking arm 44 of the product picking device 36 rotate about their axis 40, 46, respectively, as the product delivery device 36 moves between the pick position and the delivery position to pick two exemplary pouches (referred to as either pouches 14 or pouches 14*a*, 14*b*, where appropriate) from the pouch queue 98 and deliver the pouches 14*a*, 14*b* to the two shuttles 78*a*, 78*b*, respectively, which are located in the load zone 80*a* on the table 72 of the product transfer apparatus 12. To this end, the load zone 80*a* is located within a spatial reach of the product delivery device 36 to enable the efficient transfer of pouches 14 to the shuttles 78*a*, 78*b*.

As shown in FIGS. 2A and 2B, the two exemplary shuttles 78*a*, 78*b* are positioned within the load zone 80*a*, with one shuttle 78*a* being positioned in slot LZ1 and the other shuttle 78*b* being positioned in slot LZ2. The pouch delivery device 36 is configured to deposit at least one pouch 14 in each shuttle 78*a*, 78*b* such that each shuttle receives a single pouch 14 from the product delivery device 36. Specifically, a single pouch 14 is deposited into each shuttle 78*a*, 78*b* in a pre-selected common orientation relative to the shuttle 78*a*, 78*b* and the longitudinal axis 90 of the table 72 of the product transfer apparatus 12. Each pouch 14 is elongated and extends between a head region ("head") 100 and a toe region ("toe") 102 to define a longitudinal axis of the pouch 14. As shown in FIG. 2B, each pouch 14 is deposited in the respective shuttle 78*a*, 78*b* such that the longitudinal axis of the pouch 14 is generally perpendicular to the longitudinal axis 90 of the product transfer apparatus 90. To this end, each pouch 78 is deposited in the shuttle 78*a*, 78*b* with the toe 102 positioned at the front of the shuttle 78*a*, 78*b* (e.g., movement arrows A1 are pointing in a forward direction) and the head 100 positioned at the rear of the shuttle 78*a*, 78*b*. Once the pouches 14 have been deposited in respective shuttles 78*a*, 78*b*, the product delivery device 36 rotates back to the pick position to pick two more pouches 14.

Once the pouches 14 have been deposited into each of the shuttles 78*a*, 78*b* by the product delivery device 36, a pouch-in-place condition is satisfied that signals to the product transfer apparatus 12 that the two shuttles 78*a*, 78*b* in the load queue 80*a* have each been loaded with a pouch 14. In that regard, the pouch-in-place condition may be satisfied through movement of the product delivery device 36 back to the pick position. For example, a sensor that detects the position of the product delivery device 36, such as a positional sensor, may be used to determine when the product delivery device 36 returns to the pick position. To this end, once the product delivery device 36 returns to the pick position, the pouch-in-place condition for the system is satisfied. Alternatively, each shuttle 78 has the capability to detect the presence of a payload and measure its weight. This is achieved by measuring the current required to maintain the height of levitation of the shuttle 78 when it is empty compared to when it is loaded with a payload. Since a loaded shuttle 78 requires additional current to maintain the same levitation height, the difference in current can be attributed to the presence and the weight of the payload. In the embodiment shown, by using this difference in current, the shuttles 78*a* and 78*b* can determine the presence of a pouch 14, thereby satisfying the pouch-in-place condition for the system.

Figure 3A:
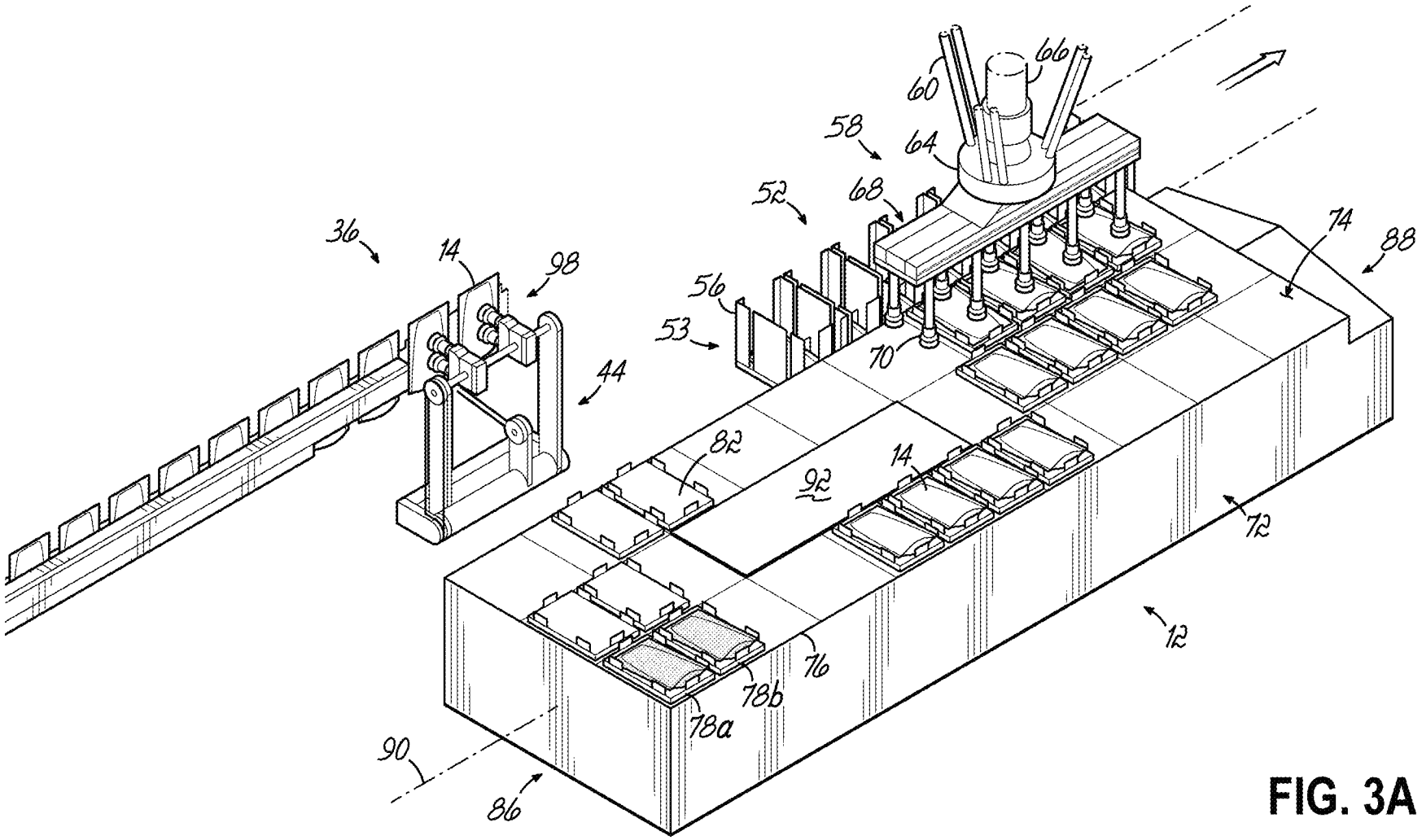
FIG. 3A is a perspective view of the product transfer apparatus, illustrating the two exemplary shuttles, each carrying a pouch, moved from the load zone to a transient zone.
Figure 3B:
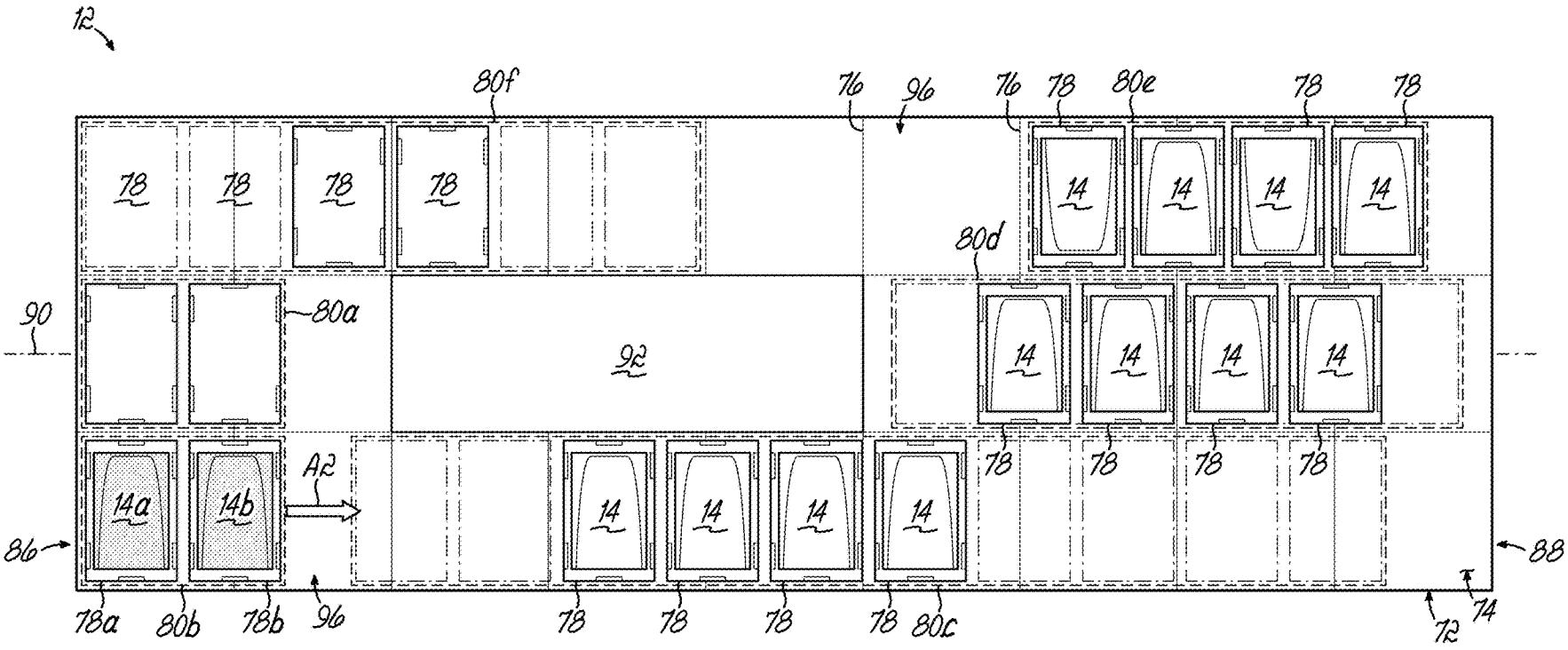
FIG. 3B is a schematic top view of the perspective view of the table shown in FIG. 3A, illustrating a position of each moving element about the table at that instant in time.
Figure 4A:
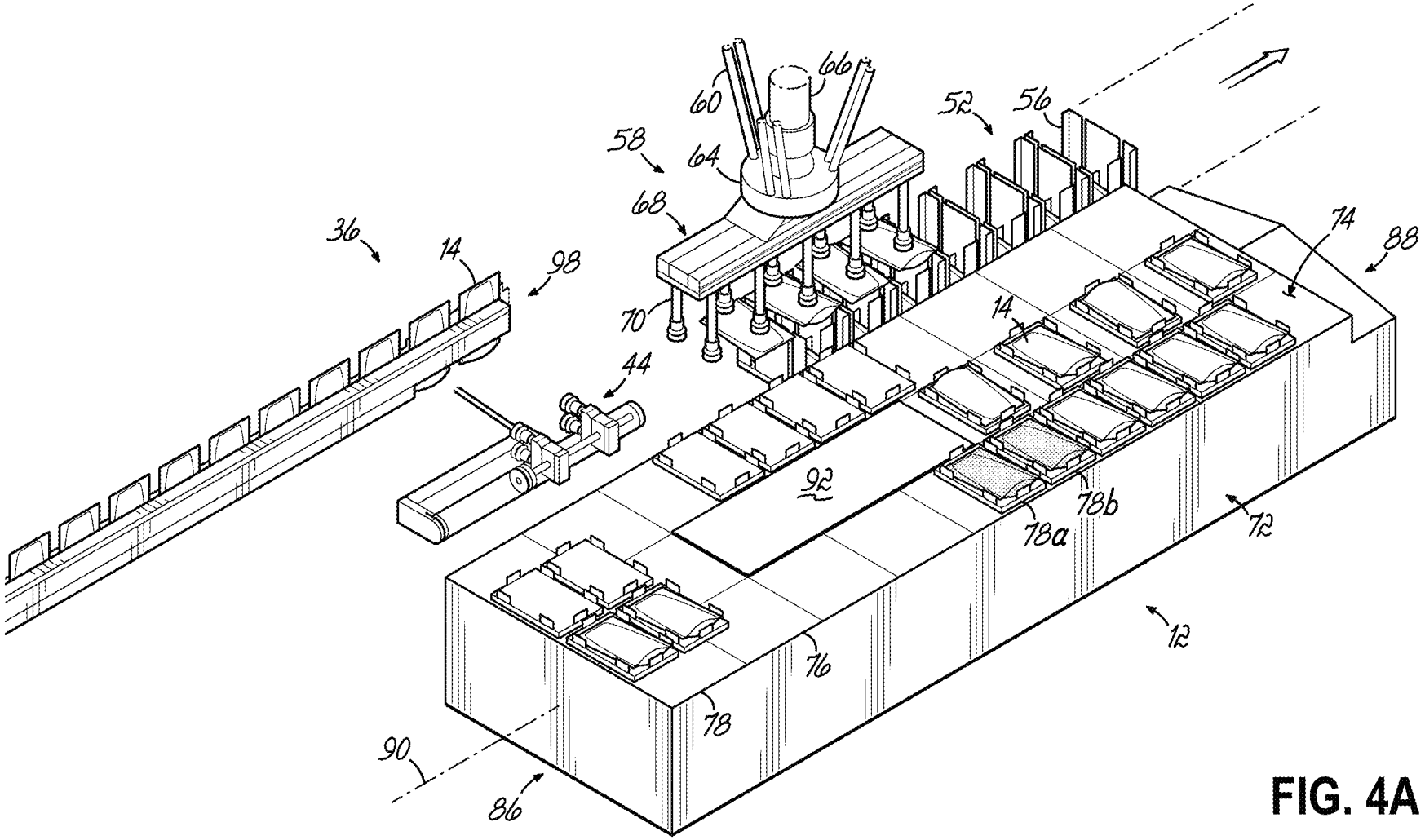
FIG. 4A is a perspective view of the product transfer apparatus, illustrating the two exemplary shuttles, each still carrying a pouch, moved from the transient zone to a picking queue.
Figure 4B:
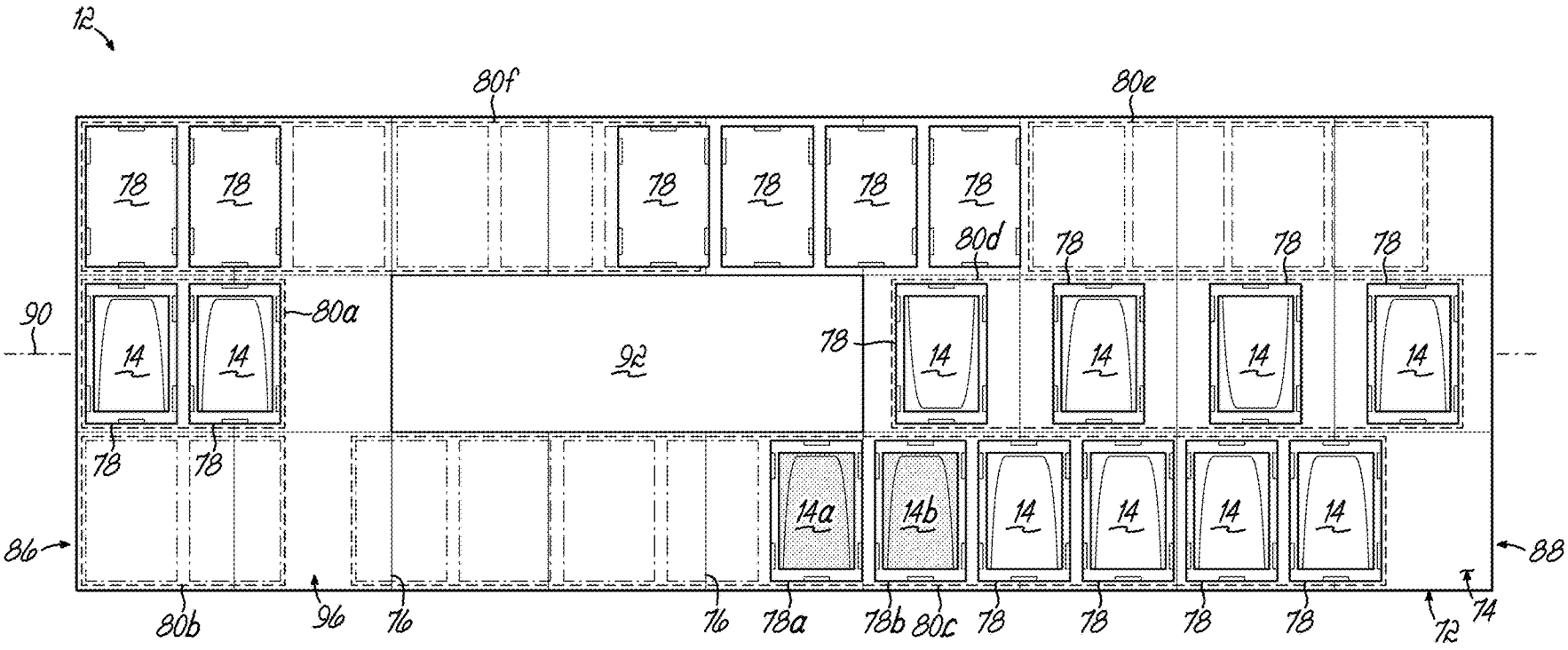
FIG. 4B is a schematic top view of the perspective view of the table shown in FIG. 4A, illustrating a position of each moving element about the table at that instant in time.

Once the pouch-in-place condition is satisfied, motion of the shuttles 78*a*, 78*b* is triggered and the shuttles are moved from the load zone 80*a* to the transient zone 80*b*, as indicated by directional arrows A1 in FIG. 2B. Once the two shuttles 78*a*, 78*b* clear the load zone 80*a*, two more shuttles 78 immediately move into the load zone 80*a* from the loading queue 80*f* to receive two more pouches 14, as will be described in further detail below. With respect to the exemplary two shuttles, 78*a*, 78*b* as shown in FIGS. 3A and 3B, one shuttle 78*a* is moved from slot LZ1 in the load zone 80*a* to slot TZ1 in the transient zone 80*b*. The other shuttle 78*b* is moved from slot LZ2 in the load zone 80*a* to slot TZ2 in the transient zone 80*b*. The shuttles 78*a*, 78*b* may slow or temporarily pause over respective slots TZ1, TZ2 in the transient zone 80*b* before moving to the picking queue 80*c*. As shown in FIG. 3B, the shuttles 78*a*, 78*b* next advance from the transient zone 80*b* to the picking queue 80*c*, as indicated by directional arrow A2. However, as shown in FIG. 3B, there may be one or more shuttles 78 already positioned within picking queue 80*c*. For example, FIG. 3B illustrates an instant in time in which there are four shuttles 78 in the picking queue 80*c*, in slots PQ1-PQ4. As the two shuttles 78*a*, 78*b* are advanced from the transient zone 80*b* into the picking queue 80*c*, the shuttles 78 in slots PQ1-PQ4 are simultaneously advanced within the picking queue 80*c* to slots PQ4-1 through PQ4-4 to make room for the two shuttles 78*a*, 78*b* within the picking queue 80*c*, as shown in FIGS. 4A and 4B. As shown in FIG. 4B, one shuttle 78*a* is moved from slot TZ1 in the transient zone 80*b* to slot PQ2 in the loading queue 80*c*. The other shuttle 78*b* is moved from slot TZ2 in the transient zone 80*b* to slot PQ1 in the loading zone 80*c*.

Figure 5A:
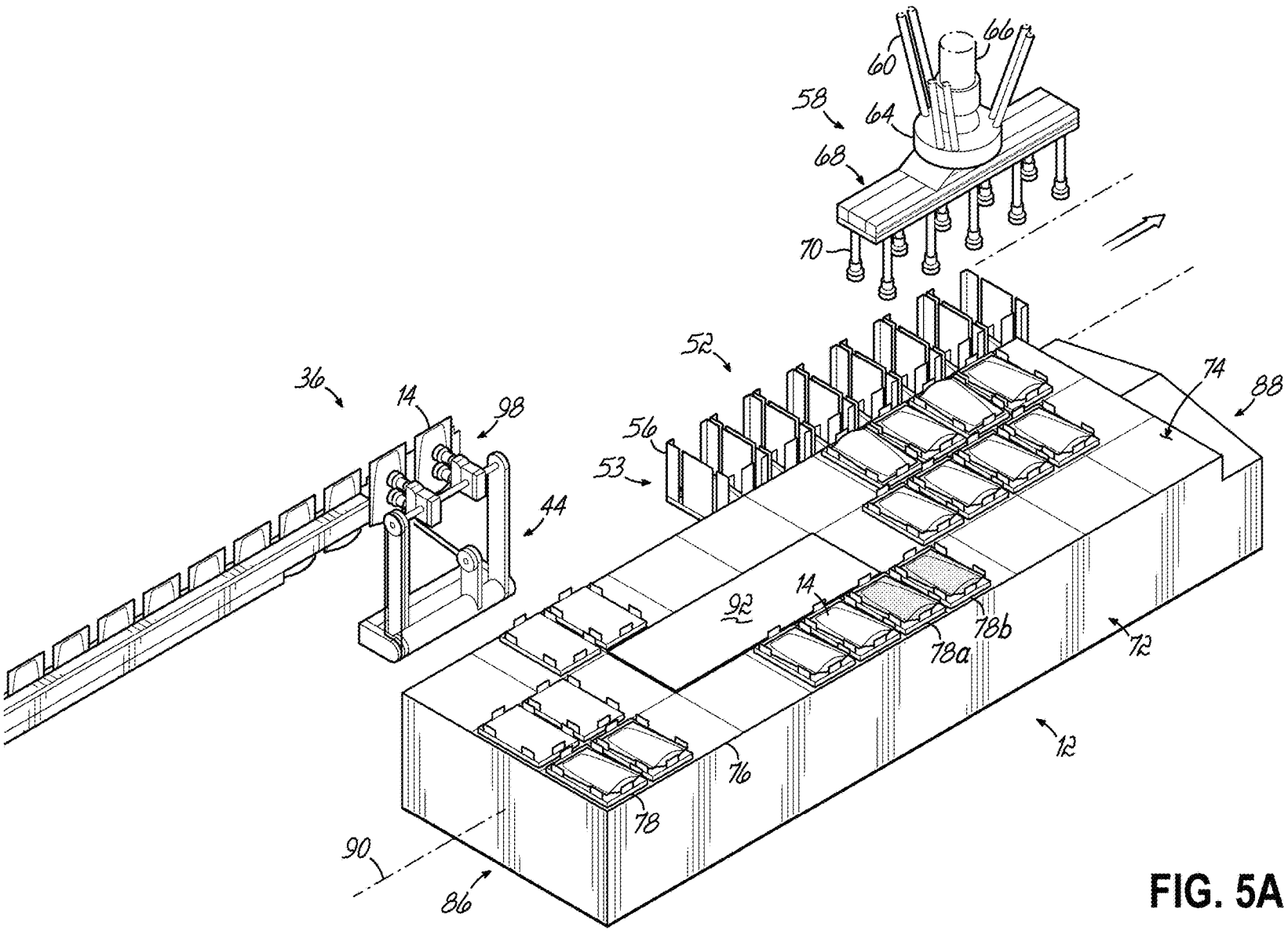
FIG. 5A is a perspective view of the product transfer apparatus, illustrating the two exemplary shuttles, each still carrying a pouch, remaining in the picking queue for additional shuttles to accumulate.
Figure 5B:
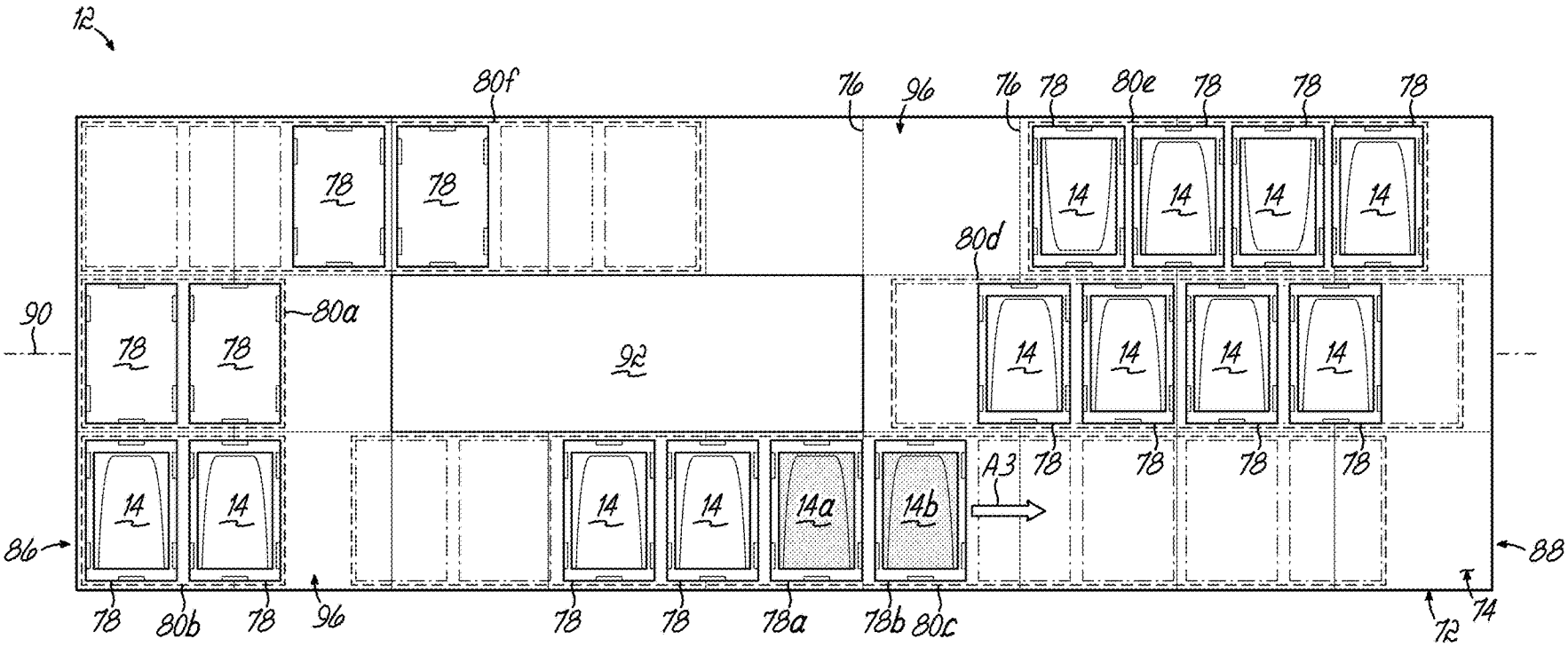
FIG. 5B is a schematic top view of the perspective view of the table shown in FIG. 5A, illustrating a position of each moving element about the table at that instant in time.

With reference to FIGS. 5A and 5B, the shuttles 78*a*, 78*b* may pause or stop within the loading queue 80*c* for a period of time while other shuttles 78 move into or out from the loading queue 80*c*. For example, the shuttles 78*a*, 78*b* may remain stationary while the group of four shuttles 78 in slots PQ4-1 through PQ4-4 are moved into the staging zone 80*d*, as shown in e.g., FIG. 5B. Furthermore, the shuttles 78*a*, 78*b* remain stationary within their respective slots PQ2, PQ1 until additional shuttles 78 are received into the picking queue 80*c* to form a group of four shuttles 78 that includes the exemplary two shuttles 78*a*, 78*b*, as shown. To this end, slots PQ1-PQ6 form a temporary upstream buffer for slots PQ4-1 through PQ4-4 within the picking queue 80*c*. This buffer arrangement can be used to facilitate hole healing as will be described in further detail below.

Figure 6A:
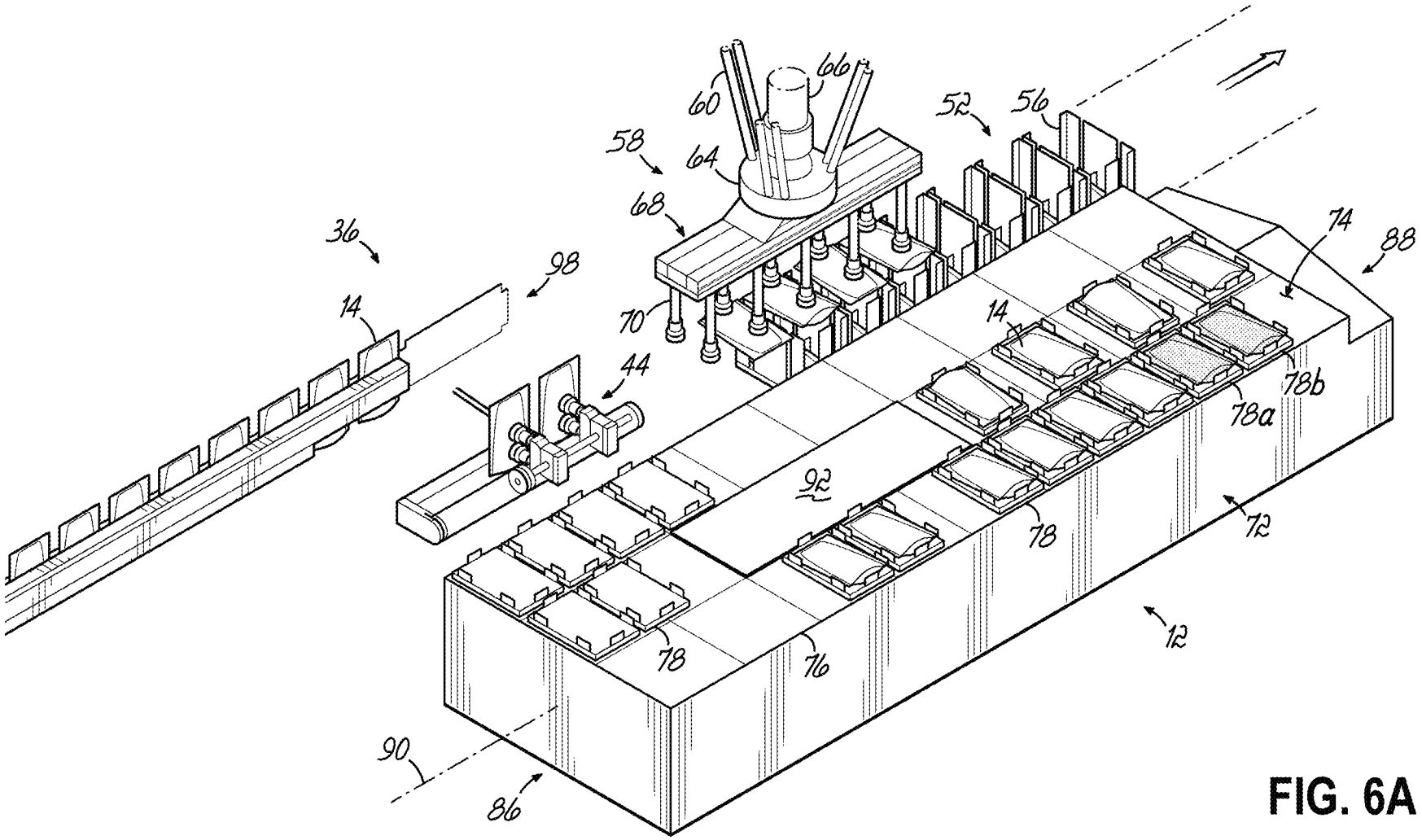
FIG. 6A is a perspective view of the product transfer apparatus, illustrating the two exemplary shuttles, each still carrying a pouch, advanced to a different position within the picking queue.
Figure 6B:
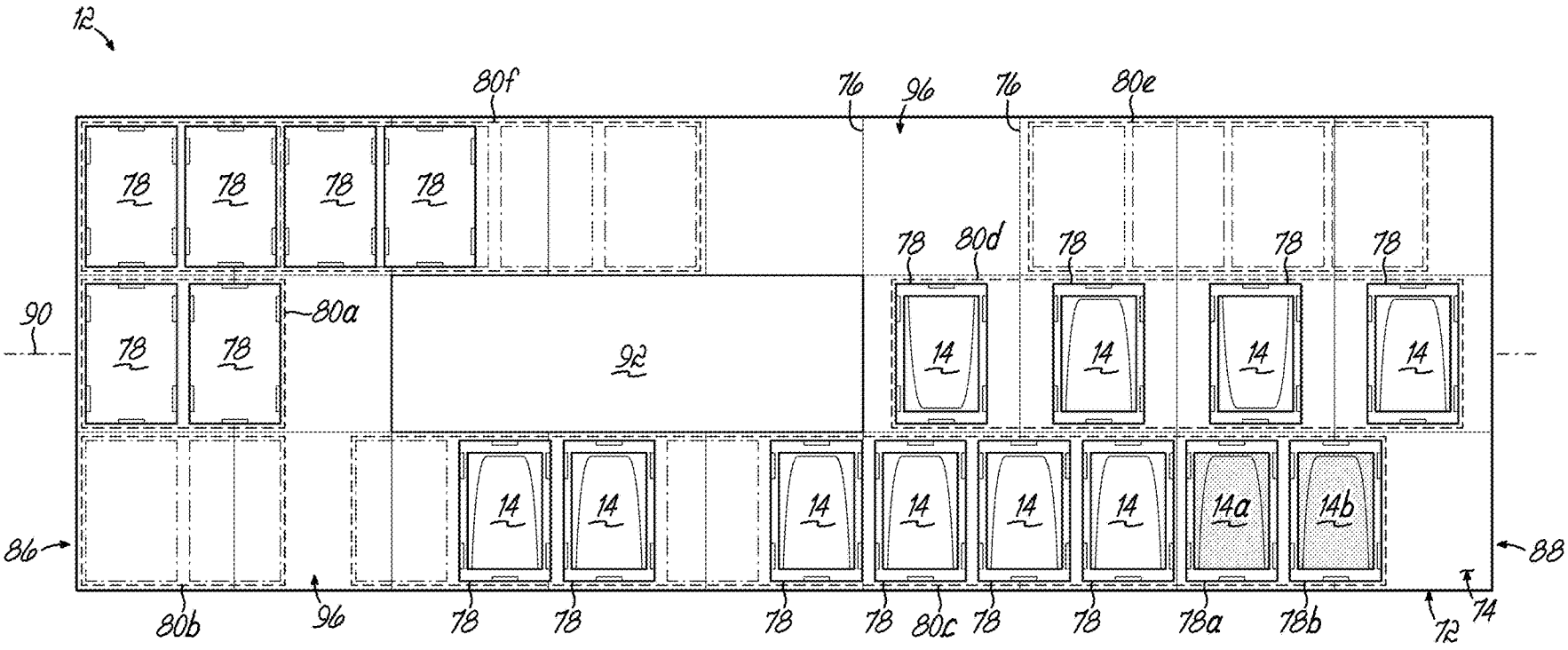
FIG. 6B is a schematic top view of the perspective view of the table shown in FIG. 6A, illustrating a position of each moving element about the table at that instant in time.

With continued reference to FIG. 5B, the group of four shuttles 78*a*, 78*b*, 78 is advanced within the picking queue from slots PQ1-PQ4 to slots PQ4-1 through PQ4-4, as indicated by directional arrow A3. With respect to the exemplary two shuttles 78*a*, 78*b*, one shuttle 78*a* is moved from slot PQ2 to slot PQ4-2 within the picking queue 80*c* and the other shuttle 78*b* is moved from slot PQ1 to slot PQ4-1 within the picking queue 80*c*. The group of four shuttles 78*a*, 78*b*, 78 may slow or temporarily pause over slots PQ4-1 through PQ4-4, as shown in FIGS. 6A and 6B, depending on the status of shuttles 78 within the staging zone 80*d*. To this end, additional shuttles 78 are moved into the picking queue 80*c* to backfill at least slots PQ1-PQ4 in a similar manner as described above.

Movement of shuttles 78 from the picking queue 80*c* into the staging zone 80*d* and subsequently into the pick zone 80*e* is triggered by a pick-clear condition and a staging zone ready condition being satisfied. The pick-clear condition is satisfied when all pouches 14 have been picked from shuttles 78 in the pick zone 80*e* and the shuttles 78 moved out of the pick zone 80*e*. The staging zone ready condition is satisfied when one or more of the shuttles 78 in the staging zone have completed a reorientation operation, as will be described in further detail below. With respect to the pick-clear condition, the product picking device 58 may include a sensor that detects the position of the product picking device 58, such as a positional sensor, to determine when the product picking device picks pouches 14 from the shuttles 78 in the pick zone 80*e*. Alternatively, each shuttle 78 may be configured to detect the presence of a payload when in the pick zone 80*e*. In either case, movement of the empty shuttles 78 from pick zone 80*e* to the loading queue 80*f* is tracked by the product transfer apparatus, such as through the use of one or more photo-eye sensors, for example. To this end, once a picking operation is detected by the sensor or by the absence of payload in the shuttles 78, movement of the shuttles 78 from the pick zone 80*e* to the loading queue 80*f* is triggered. Once the shuttles 78 are moved out of the pick zone 80*e*, the pick-clear condition for the system is satisfied.

Figure 7A:
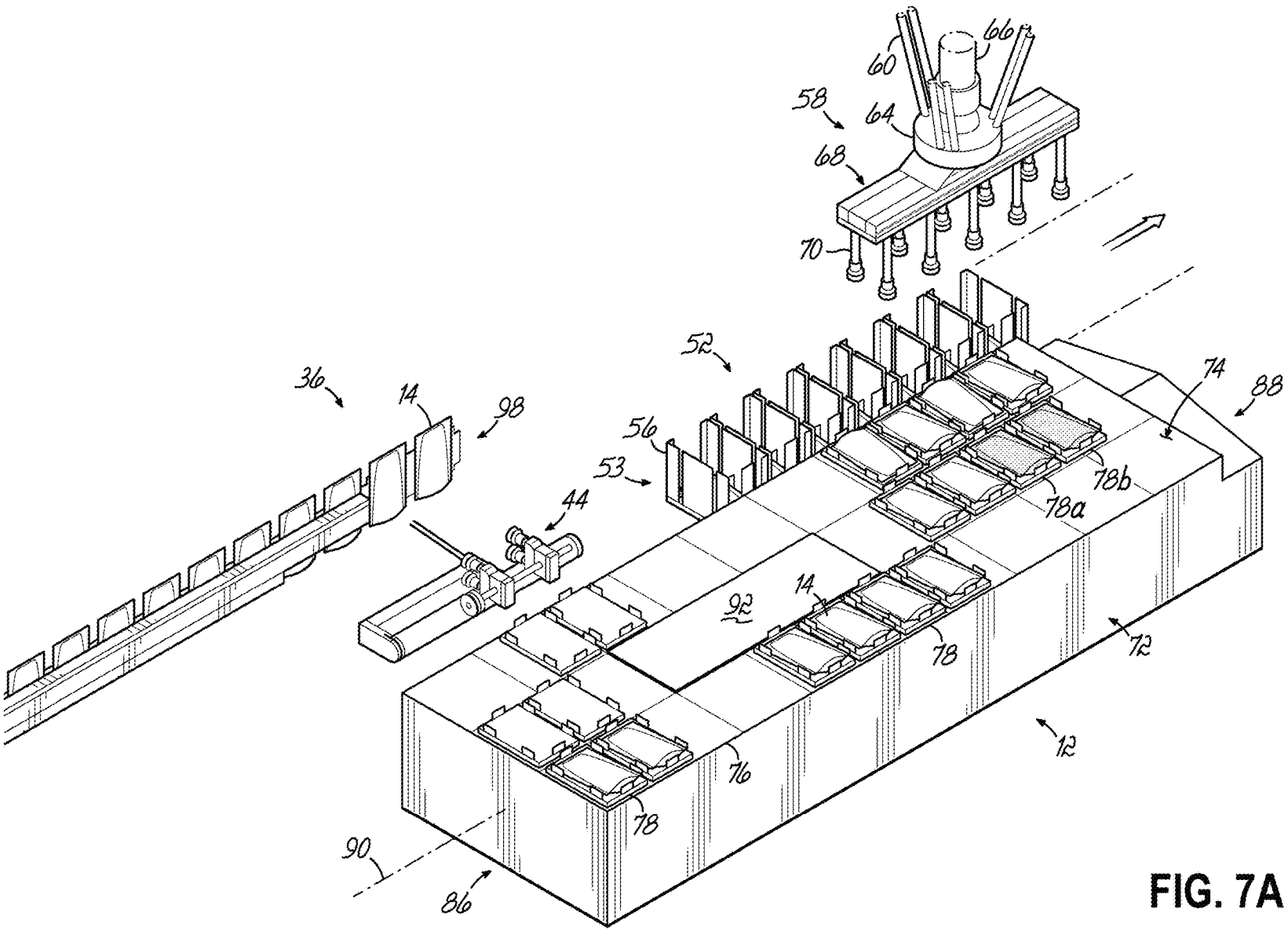
FIG. 7A is a perspective view of the product transfer apparatus, illustrating the two exemplary shuttles, each still carrying a pouch, moved from the picking queue to a staging zone.
Figure 7B:
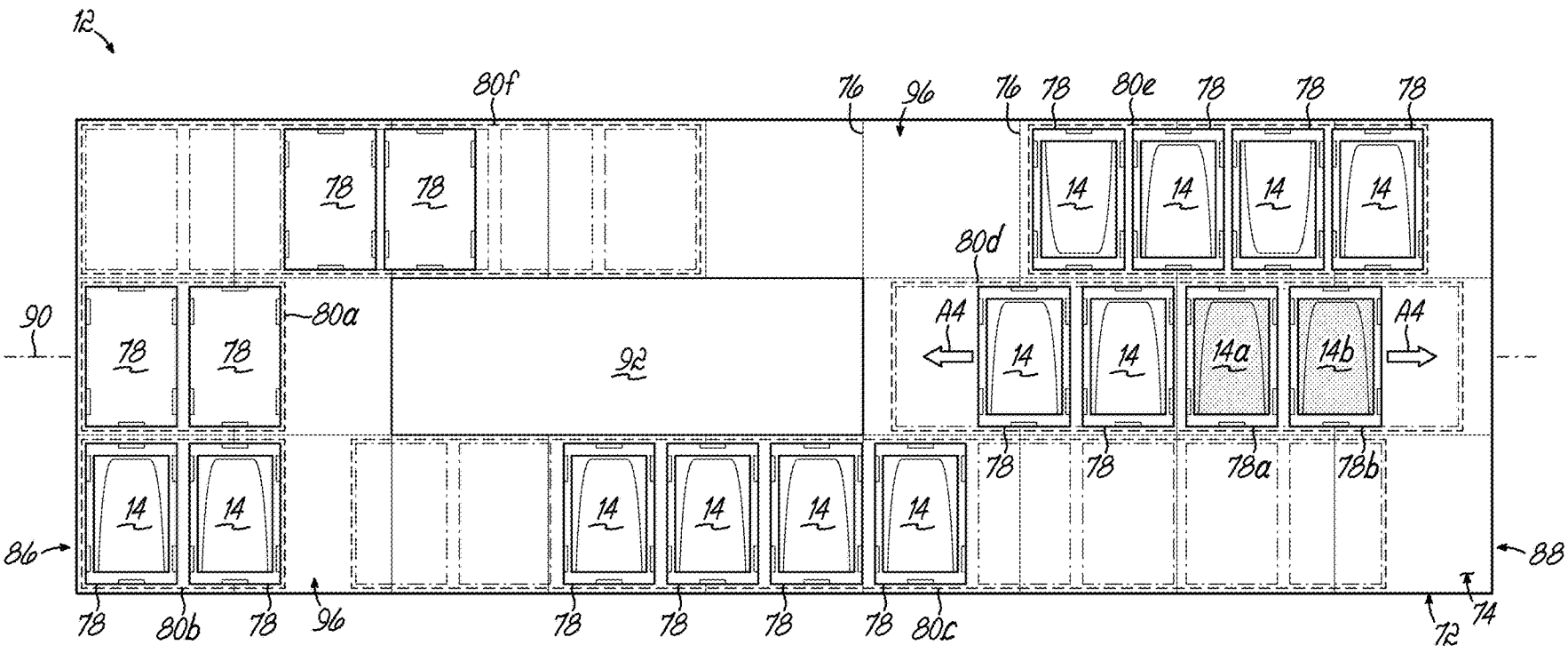
FIG. 7B is a schematic top view of the perspective view of the table shown in FIG. 7A, illustrating a position of each moving element about the table at that instant in time.

FIGS. 6A and 6B illustrate the product transfer apparatus 12 in a state where both the pick-clear condition and the staging zone ready condition have been satisfied. In that regard, the shuttles 78 in the staging zone 80*d* are moved into the empty pick zone 80*e* and the group of shuttles 78, 78*a*, 78*b* in the picking queue 80*c* is simultaneously moved into the staging zone 80*d*. In particular, as shown in FIGS. 7A and 7B, the group of four shuttles 78, 78*a*, 78*b*, including the exemplary two shuttles 78*a*, 78*b* is moved from slots PQ4-1 through PQ4-4 of the picking queue 80*c* into the staging zone 80*d*. The group of four shuttles 78, 78*a*, 78*b* is initially moved into the staging zone 80*d* as a compact group, as shown in FIG. 7B. Once the compact group of shuttles 78, 78*a*, 78*b* is moved in the staging zone 80*d*, the shuttles 78, 78*a*, 78*b* are moved in the lengthwise direction along the longitudinal axis 90 of the table 72 to respective slots SZ1-SZ4, as indicated by directional arrows A4, to thereby space the shuttles 78, 78*a*, 78*b* apart. With respect to the exemplary two shuttles 78*a*, 78*b*, one shuttle 78*a* is moved from slot PQ4-2 of the picking queue 80*c* to slot SZ2 of the staging zone 80*d*. The other shuttle 78*b* is moved from slot PQ4-1 of the picking queue 80*c* to slot SZ1 of the staging zone.

Movement of the shuttles from the picking queue 80*c* is into the staging zone 80*d* is based on the n-count configuration of the system which is dictated by the carton load requirements. In the exemplary embodiment shown, the product transfer apparatus 12 is configured for a 4-count operation, meaning that four pouches 14 are removed from the product transfer apparatus 12 at a time to be placed in one or more cartoner buckets 56. However, should the product transfer apparatus 12 be configured for a 3-count operation, only three shuttles 78 would move from the picking queue 80*c* into the staging zone 80*d*. For example, shuttles 78 would move from slots PQ4-1 through PQ4-3 of the picking to queue 80*c* to slots SZ1-SZ3 of the staging zone 80*d*. The three shuttles 78 in the staging zone would then move from the staging zone 80*d* into the pick zone 80*e*, in a manner similar to that described below for the 4-count configuration. For a 2-count operation, only two shuttles 78 would move from the picking queue 80*c* into the staging zone 80*d*, and then into the pick zone 80*e*.

Figure 8A:
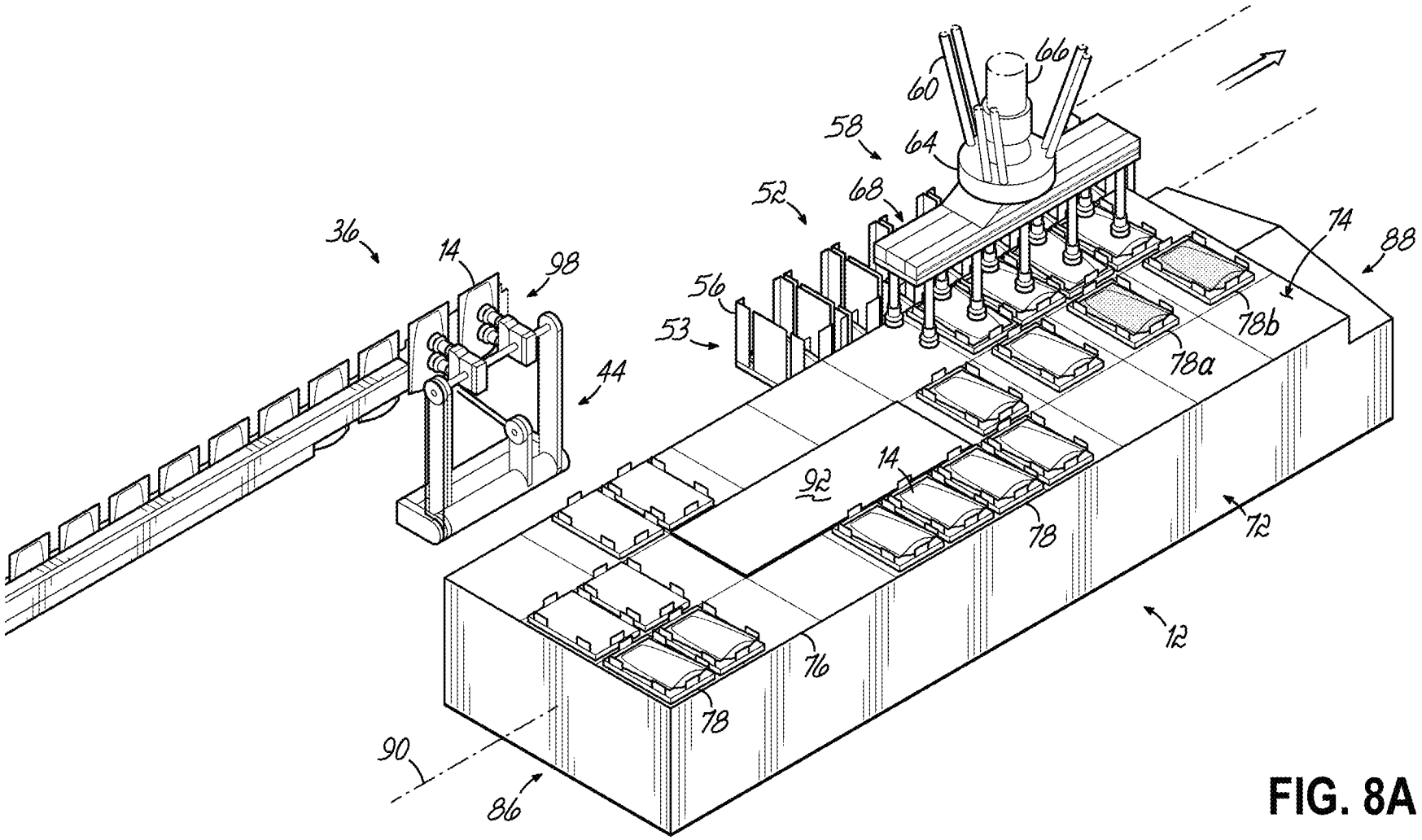
FIG. 8A is a perspective view of the product transfer apparatus, illustrating the two exemplary shuttles, each still carrying a pouch, spaced apart and at least one shuttle rotating within the staging zone to change an orientation of the shuttle.
Figure 8B:
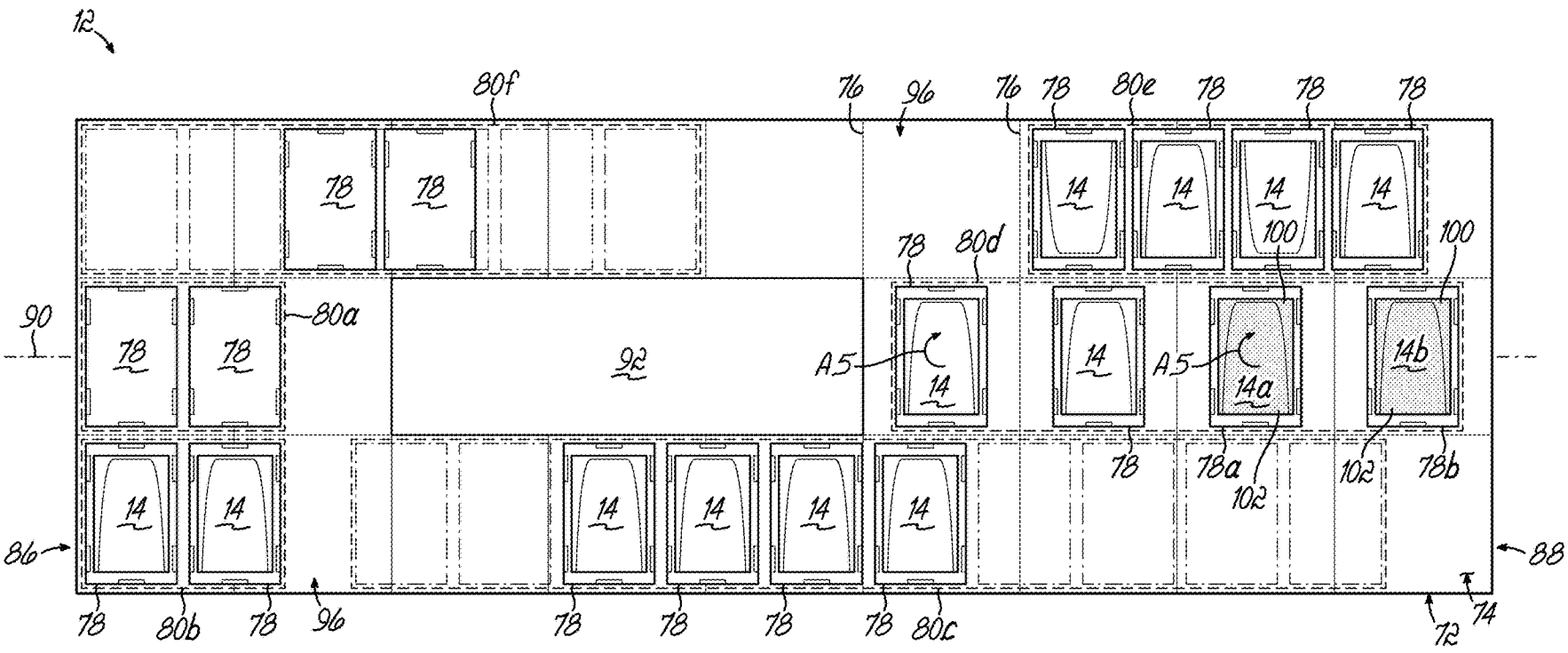
FIG. 8B is a schematic top view of the perspective view of the table shown in FIG. 8A, illustrating a position of each moving element about the table at that instant in time.

With reference to FIGS. 8A and 8B, once each of the shuttles 78, 78*a*, 78*b* is positioned over a respective slot SZ1-SZ4 within the staging zone 80*d*, a reorientation operation is triggered that reorients one or more of the shuttles 78, 78*a*, 78*b* in the staging zone 80*d*. Specifically, one or more of the shuttles 78, 78*a*, 78*b* in the staging zone 80*d* is rotated 180° about a center of a respective slot SZ1-SZ4. To allow for such rotation, the slots SZ1-SZ4 are generally located a center of each respective electromagnetic motor module 76. After rotation of the shuttles 78 is complete, one or more of the shuttles 78, and thus the pouch 14 held by the shuttle 78, is different by 180° from the pre-selected common orientation of the pouches 14 received by the shuttles 78 in the load zone 80*a*. The reorientation operation allows the pouches 14 to be stacked in a head-to-toe arrangement with cartoner buckets by the product picking device 58, as will be described in further detail below.

As shown in FIGS. 8A and 8B, two shuttles 78*a*, 78 out of the group of four shuttles 78*a*, 78*b* 78 is rotated in a clockwise direction, as indicated by directional arrows A5. In particular, the shuttle 78*a* in slot SZ2 and the shuttle in slot SZ4 are each rotated 180° in a clockwise direction. As a result, once the reorientation operation is complete, the pouches 14 held by the group of four shuttles 78*a*, 78*b* 78 are in sequential reverse orientation relative to each other. However, other reorientation configurations are possible, such as rotating the shuttles 78*b*, 78 in slots SZ1 and SZ3, respectively, or only rotating the shuttles 78*a*, 78*b* in slots SZ2 and SZ1 or only rotating the shuttles 78 in slots SZ3 or SZ4, for example. Rotation may either be in the clockwise direction or counterclockwise direction. For example, one shuttle 78 may be rotated in a clockwise direction while another shuttle is simultaneously rotated in a counterclockwise direction. To this end, one or all of the shuttles 78 in the staging zone 80*d* may be rotated in any direction by any degree of rotation within a range of between 0° and 360° about a center of a respective slot SZ1-SZ4 to achieve a desired reorientation configuration for downstream cartoning of the pouches 14.

Figure 9A:
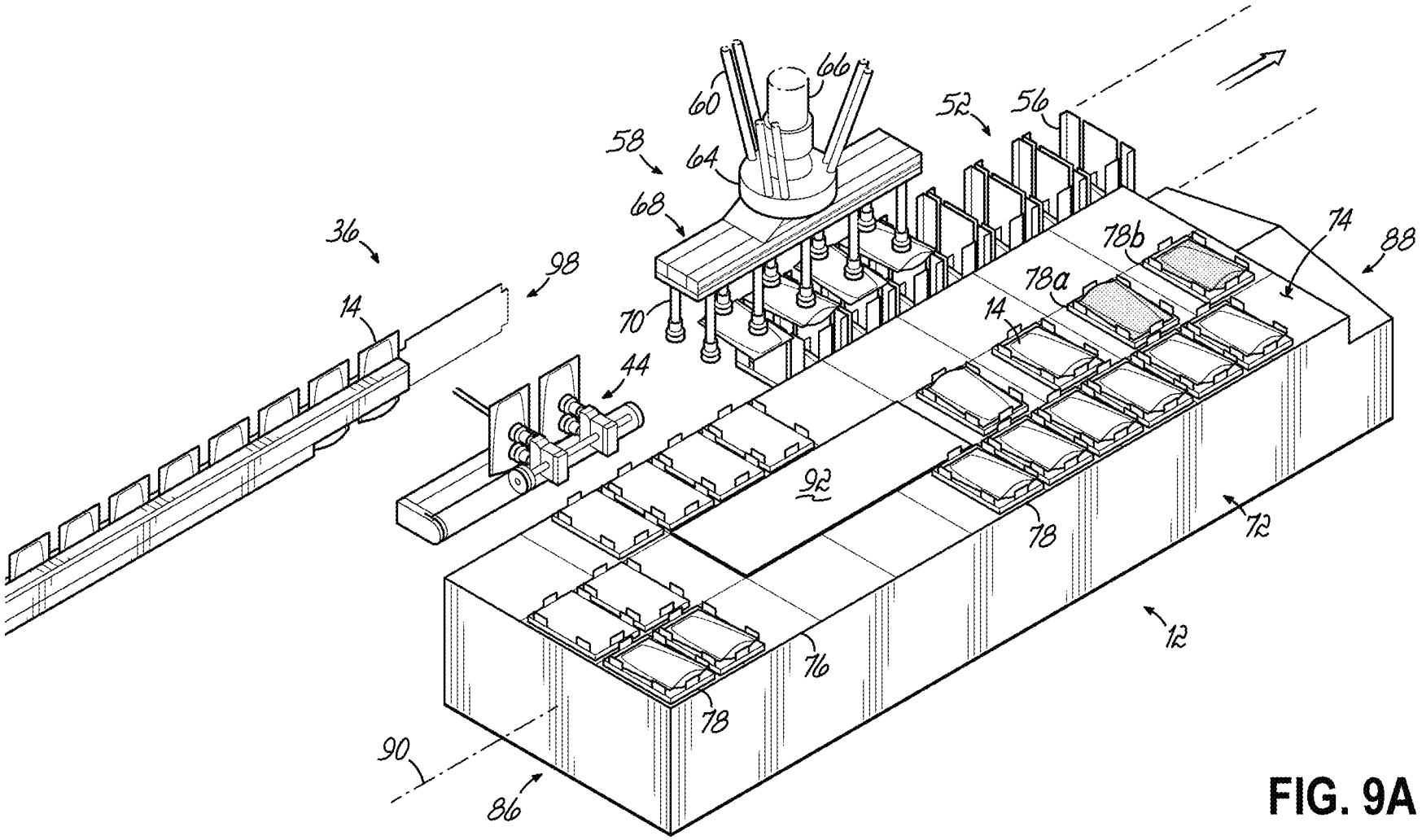
FIG. 9A is a perspective view of the product transfer apparatus, illustrating the two exemplary shuttles, each still carrying a pouch, reoriented within the staging zone.
Figure 9B:
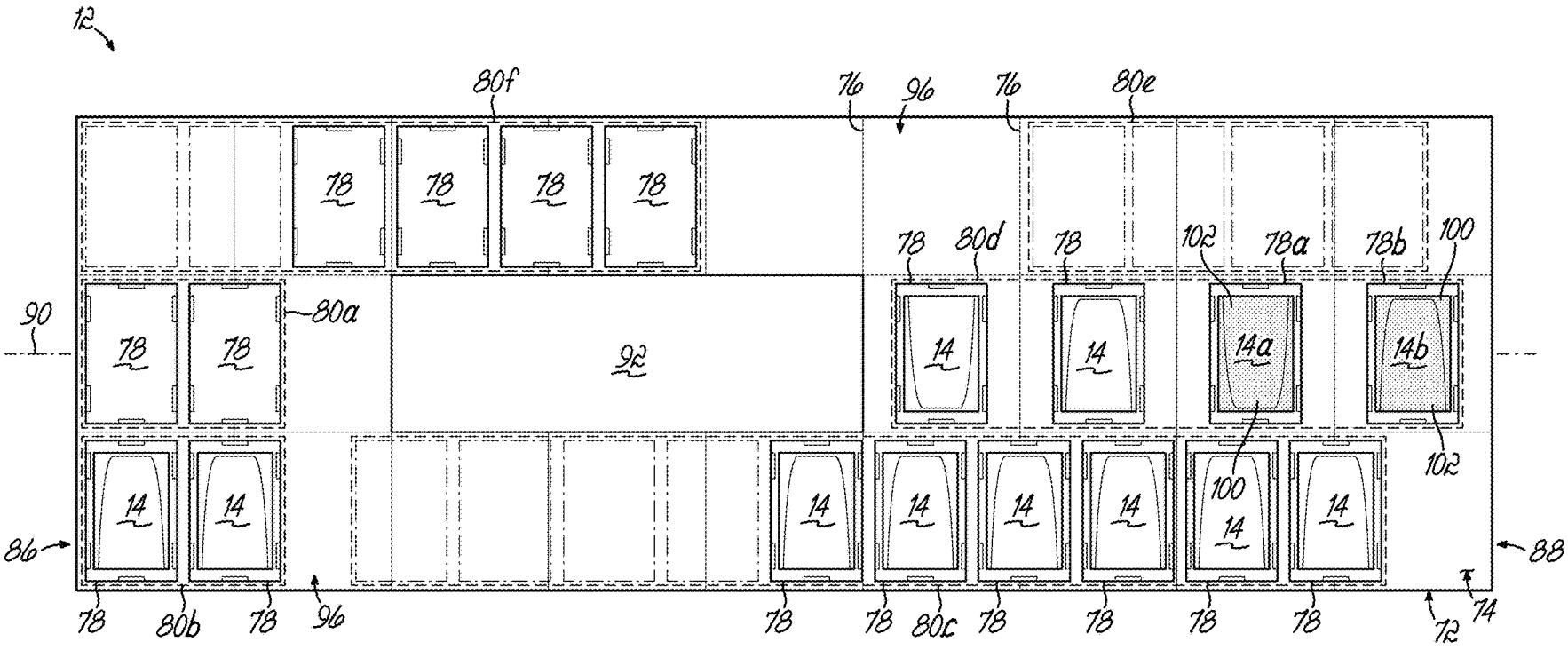
FIG. 9B is a schematic top view of the perspective view of the table shown in FIG. 9A, illustrating a position of each moving element about the table at that instant in time.
Figure 10A:
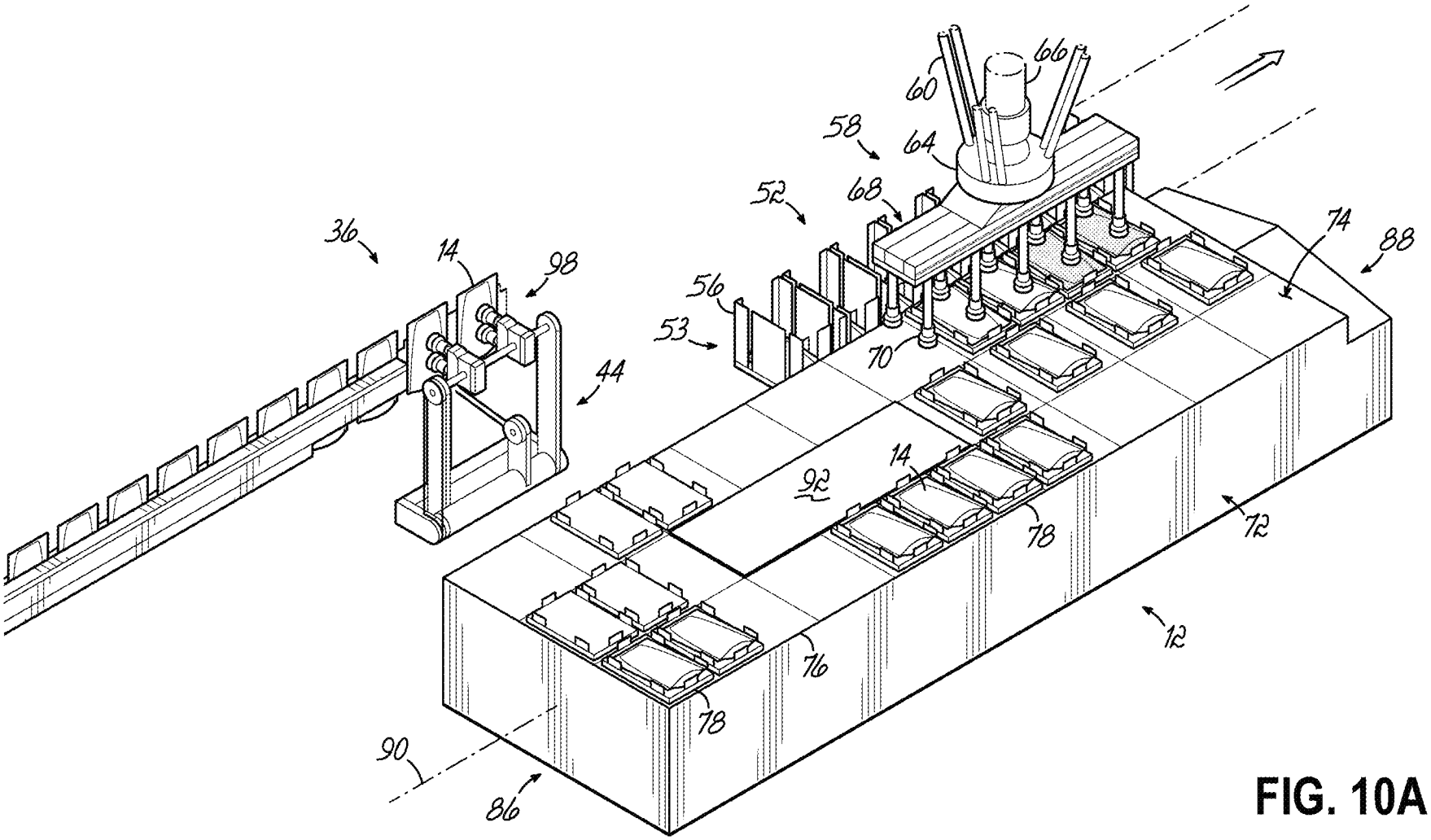
FIG. 10A is a perspective view of the product transfer apparatus, illustrating the two exemplary shuttles, each still carrying a pouch, moved from the staging zone to a pick zone where the pouches are removed from the two exemplary shuttles by a product picking device.

FIGS. 9A and 9B illustrate the product transfer apparatus 12 in a state where both the pick-clear condition and the staging zone ready condition have been satisfied. In that regard, the group of shuttles 78, 78*a*, 78*b* in the staging zone 80*d* are moved into the empty pick zone 80*e* and the group of shuttles 78 in the picking queue 80*c* is simultaneously moved into the staging zone 80*d*. In particular, as shown in FIGS. 10A and 10B, the group of four shuttles 78, 78*a*, 78*b*, including the exemplary two shuttles 78*a*, 78*b* is moved from slots SZ1-SZ4 of the staging zone 80*d* to slots PZ4-1 through PZ4-4 of the pick zone 80*e*. The group of four shuttles 78, 78*a*, 78*b* may move back into a compact group within the staging zone 80*d* before moving into the pick zone 80*e* or may move from their positions within the staging zone 80*d* directly into a compact position within the pick zone 80*e*. In either case, the group of shuttles 78, 78*a*, 78*b* is arranged in a compact group over slots PZ4-1 through PZ4-4 within the pick zone 80*e* for the picking operation. With respect to the exemplary two shuttles, 78*a*, 78*b*, one shuttle 78*a* is moved from slot SZ2 in the staging zone 80*d* to slot PZ4-2 in the pick zone 80*e*. The other shuttle 78*b* is moved from slot SZ1 in the staging zone 80*d* to slot PZ4-1 in the pick zone 80*e*.

The location and spacing of the shuttles 78 in the pick zone 80*e* are determined by the n-count configuration of the system, which is based on the carton load requirements. For instance, in a 3-count configuration, the shuttles 78 may be spaced further apart within the pick zone 80*e* compared to a 4-count or 2-count configuration. As such, the slots PZ4 through PZ4-4, along with the spacing and location of the shuttles 78 in the pick zone 80*e*, may be adjusted to match the pitch of the cartoner bucket(s) 56, allowing the product picking device 58 to simultaneously place a group of pouches into separate cartoner buckets 56. Additionally, the spacing and location of the shuttles 78 in the pick zone 80*e* can also be modified to align with the spacing of the end effectors 70 of the EOAT 68.

Once the group of shuttles 78, 78*a*, 78*b* is arranged within the pick zone 80*e*, as shown in FIGS. 10A and 10B, a product picking operation of the product picking device 58 is triggered. In that regard, the product picking device 58 is moved from a home or rest position over the group of shuttles 78, 78*a*, 78*b* arranged within the pick zone 80*e*. As shown in FIG. 10A, the product picking devices moves down to simultaneously pick all four pouches 14 from the group of shuttles 78, 78*a*, 78*b* with the EOAT 68. The EOAT 68 includes five pairs of end effectors 70, but only the first four pairs may be utilized to pick each pouch 14 in the embodiment shown. The product picking device 58 then deposits the pouches 14 into at least one cartoner bucket 56 of the cartoner machine 18, in a head-to-to arrangement, as will be described in more detail below. The group of shuttles 78, 78*a*, 78*b* may dwell for a period of time in the pick zone 80*e* while the product picking device 58 completes the picking operation.

Figure 11A:
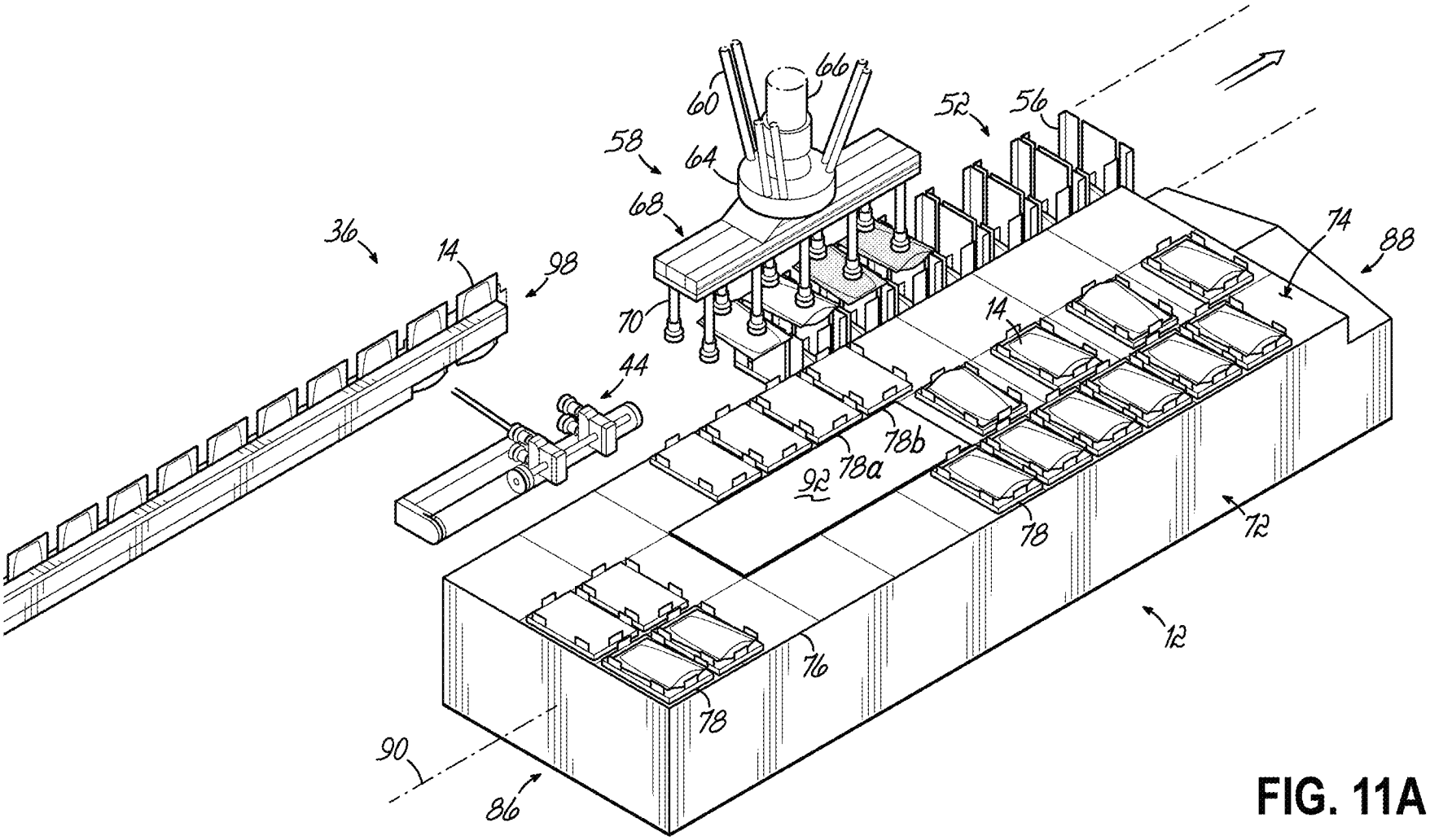
FIG. 11A is a perspective view of the product transfer apparatus, illustrating the two exemplary shuttles, no longer carrying a pouch, moved from the pick zone to a loading queue.
Figure 11B:
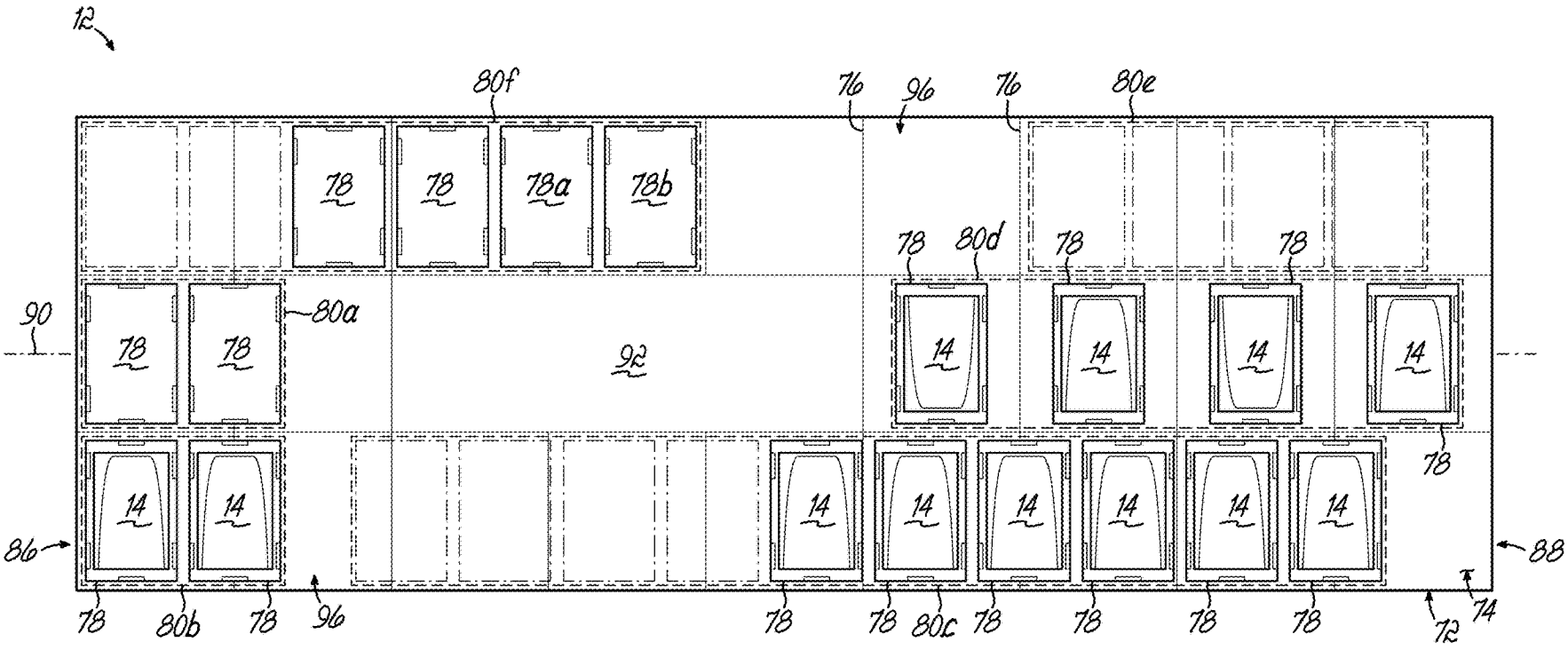
FIG. 11B is a schematic top view of the perspective view of the table shown in FIG. 11A, illustrating a position of each moving element about the table at that instant in time.

Once the product picking device 58 has complete the picking operation, meaning the pouches 14 have been removed from the group of shuttles 78, 78*a*, 78*b* arranged in the pick zone 80*e* and the product picking device 58 is moved away from the shuttles 78, 78*a*, 78*b*, motion of the empty shuttles 78, 78*a*, 78*b* from the pick zone 80*e* to the loading queue 80*f* is initiated. As shown in FIGS. 11A and 11B, the group of empty shuttles 78, 78*a*, 78*b* are moved from the pick zone 80*f* into the next available slots LQ3-LQ6 in the loading queue 80*f*. At the same time, shuttles 78 in the first two slots LQ1 and LQ2 of the loading queue 80*f* may be moved into the load zone 80*a* to be supplied with a pouch 14, as described above. Once slots LQ1 and LQ2 of the loading queue 80*f* are cleared, the group of empty shuttles 78, 78*a*, 78*b* may shift over to occupy slots LQ1-LQ4. To this end, if there are not four available slots in the loading queue 80*f*, shuttles 78 may be moved one at a time from the pick zone 80*e* to fill the slots that are available within the loading queue 80*f*.

With respect to the exemplary two shuttles 78*a*, 78*b*, one shuttle 78*a* is moved from slot PZ4-2 in the pick zone 80*e* to slot LQ5 in the loading queue 80*f*, before being furth advanced within the loading queue 80*f*. The other shuttle 78*b* is moved from slot PZ4-1 in the pick zone 80*e* to slot LQ6 in the loading queue 80*f*, before being furth advanced within the loading queue 80*f*. To this end, shuttles 78 in the loading queue 80*f* are advanced until called into the load zone 80*a* where they are supplied with a pouch 14 to complete another transit around the table 72, as described above, to supply pouches to the cartoning machine 18.

The product transfer apparatus 12 generally operates in an intermittent manner. In that regard, the motions of the shuttles 78 between zones 80*a*-80*f* at each end 86, 88 of the product transfer apparatus 12 are triggered by different events, as described above. For example, movement of shuttles 78 at the loading end 86 of the product transfer apparatus are triggered by the pouch-in-place condition being met. That is, movements of shuttles 78 from the loading queue 80*f*→the load zone 80*f*→the transient zone 80*b*→the picking queue 80*c* is based on the pouch-in-place condition being met. At the other end 88 of the product transfer apparatus 12, movement of the shuttles 78 from the picking queue 80*c*→the staging zone 80*d*→pick zone 80*e*→the loading queue 80*f* is based on the pick-clear condition and the staging zone ready condition being satisfied, as described above. To this end, the loading queue 80*f* and the picking queue 80*c* provide a certain amount of accumulation buffer to maintain operations at both ends 86, 88 of the product transfer apparatus to transfer product from the HFFS machine 16 to the cartoner machine 18. The accumulation buffer within the picking queue 80*c* also serves the additional function of reducing startup time in the event of an unexpected shutdown of the system 10. This is because the buffer allows the product to remain in place without having to reaccumulate on the product transfer apparatus 12 before the packaging operation can resume. The product transfer apparatus 12 may be capable of transferring up to 120 ppm.

Referring now to FIGS. 12A-12F, the product picking operation of the product picking device 58 will now be described in additional detail. As briefly described above, the product picking device 58 is configured to pick a group of pouches 14 from a group of shuttles 78 positioned in the pick zone 80*e* and deposit or place the pouches 14 into at least one cartoner bucket 56 of the cartoner machine 18. As a result of the orientation of one or more of the pouches 14 being changed in the staging zone 80*d*, as described above, the pouches 14 may be placed in the at least one cartoner bucket 56 in a head-to-toe arrangement. That is, the product picking device 58 need only stack the pouches 14 in one or more buckets to achieve the head-to-toe arrangement. To this end, the product picking device 58 does not need to change an orientation of the pouches 14.

Figure 12A:
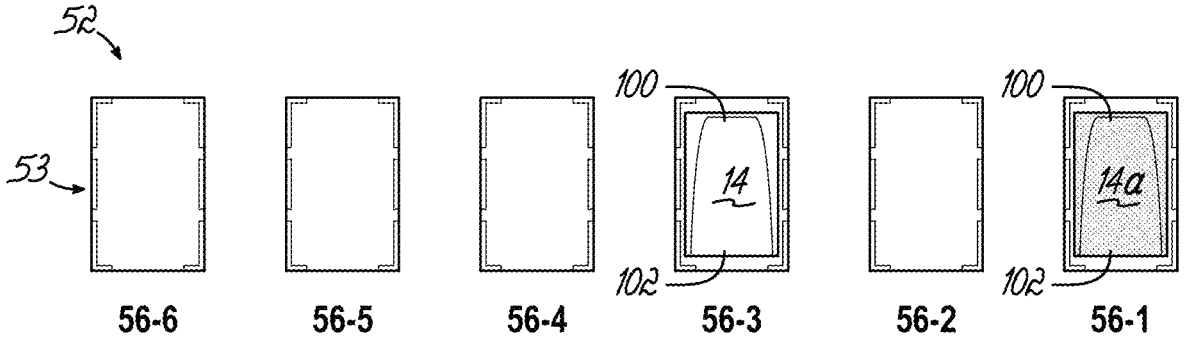
FIGS. 12A-12D are a series of schematic top views of cartoner buckets, illustrating how the product picking device places pouches within each bucket in a head-to-toe configuration in accordance with an embodiment of the invention.

An exemplary method of operating the product picking device 58 to deposit pouches 14 into one or more cartoner buckets 56 is illustrated in FIGS. 12A-12D, according to one embodiment of the invention. Starting with reference to FIG. 10B, the group of four shuttles 78, 78*a*, 78*b*, including the exemplary two shuttles 78*a*, 78*b*, is positioned over slots PZ4-1 through PZ4-4 within the pick zone 80*e*. FIG. 10A illustrates the product picking device 58 moved down to simultaneously pick all four pouches 14 from the group of shuttles 78, 78*a*, 78*b* using the EOAT 68. Once the product picking device 58 has grabbed or picked the pouches 14, the product picking device 58 moves the pouches over the product infeed device 52, and in particular the cartoner buckets 56 (e.g., FIG. 11A). FIG. 12A is a schematic representation of a select few of the cartoner buckets 56 of the product infeed device 52. For illustrative purposes, the cartoner buckets are numbered 56-1 through 56-6 in FIG. 12A. Cartoner bucket 56-6 may be adjacent to the loading end 53 of the product infeed device, for example.

With continued reference to FIG. 12A, the product delivery device 58 moves to align two pouches 14*a*, 14 of the four held pouches over cartoner buckets 56-1 and 56-3. The product delivery device 58 then performs a downward motion and releases the two pouches 14*a*, 14 from respective end effectors 70 of the EOAT 68 into cartoner buckets 56-1 and 56-3. Specifically, one pouch 14*a* is deposited into cartoner bucket 56-1 and the other pouch 14 is deposited into cartoner bucket 56-3, as shown in FIG. 12A. The pouches 14, 14*a* may be deposited in their respective cartoner bucket 56-1, 56-3 having a common orientation relative to the cartoner buckets 56-1, 56-3, for example.

Figure 12B:
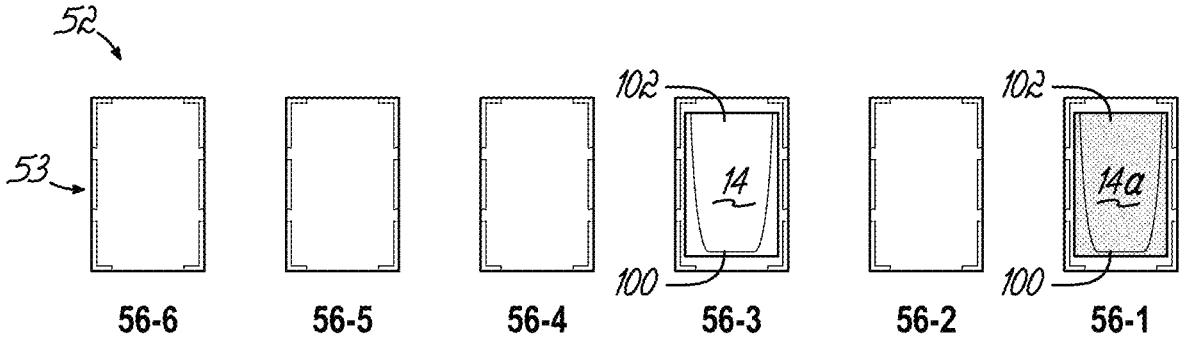

With reference to FIG. 12B, the product delivery device 58 is moved over the cartoner buckets 56-1, 56-3 to align the remaining two pouches 14*b*, 14 held by the EOAT 68 over the cartoner buckets 56-1 and 56-3. The product delivery device 58 then performs a downward motion and releases the two pouches 14*b*, 14 from respective end effectors 70 of the EOAT 68 into cartoner buckets 56-1 and 56-3. Specifically, one pouch 14*b* is deposited into cartoner bucket 56-1 on top of the pouch 14*a* previously deposited in the cartoner bucket 56-1, and the other pouch is deposited into cartoner bucket 56-3 on top of the pouch 14 previously deposited in the cartoner bucket 56-3. As shown in FIG. 12B, the pouches 14*b*, 14 may be deposited in their respective cartoner bucket 56-1, 56-3 having a common orientation relative to the shuttle cartoner buckets 56-1, 56-3, for example, that is 180° different compared to pouches 14*a*, 14 previously deposited in cartoner buckets 56-1, 56-3. This results in a head-to-toe arrangement of pouches within each cartoner bucket for efficient packaging. FIGS. 12E and 12F illustrate the head-to-to arrangement of pouches 14*a*, 14*b* in deposited in cartoner bucket 56-1. Once all four pouches 14*a*, 14*b*, 14 have been deposited in cartoner buckets 56-1, 56-3, and the product picking device moved away from the product infeed device 52 back to a home position, the picking operation of the product picking device 58 is complete.

In an alternative embodiment, the product picking device 58 may be configured to deposit two pouches in each of the first two cartoner buckets 56-1, rather than ever other cartoner bucket (e.g., 56-1 and 56-3), as described above. In that regard, filled cartoner buckets 56 would be advanced to the cartoning station 54 two at a time. Additionally, the cartoner buckets 56 may be filled with any number of pouches 14 before being advanced to the cartoning station 54 for packaging.

Figure 12C:
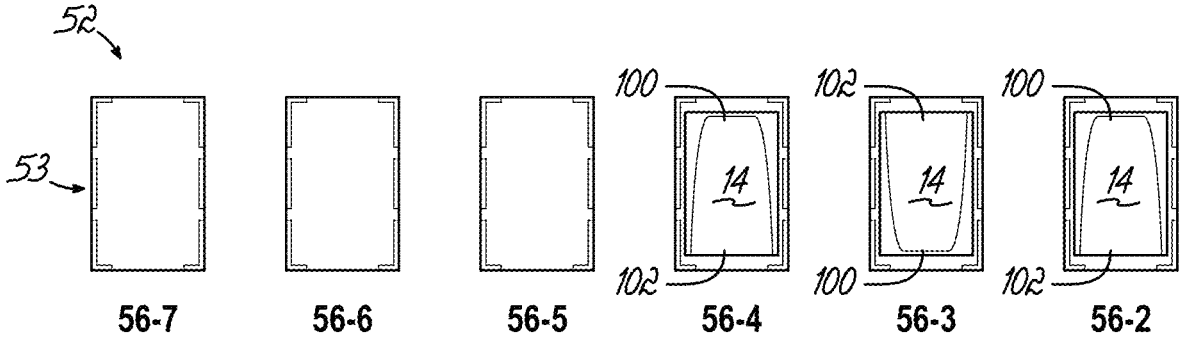
Figure 12D:
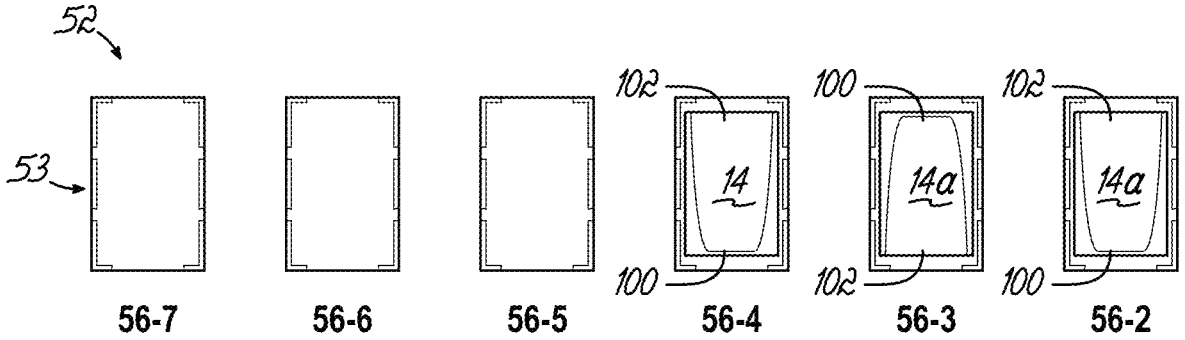
Figure 12E:
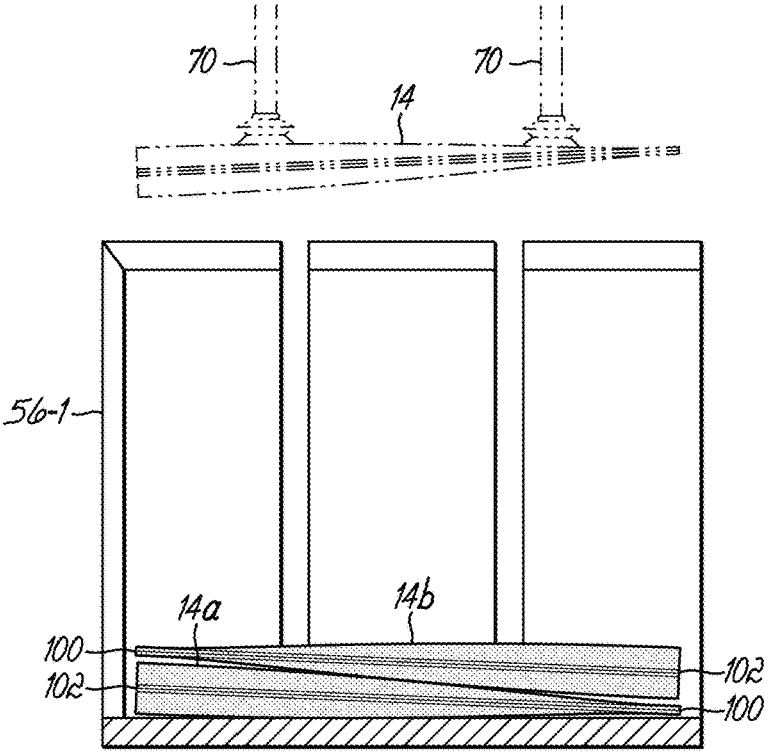
FIGS. 12E-12F are partial cross-sectional views of one cartoner bucket, illustrating pouches in a head-to-toe arrangement within the cartoner bucket.
Figure 12F:
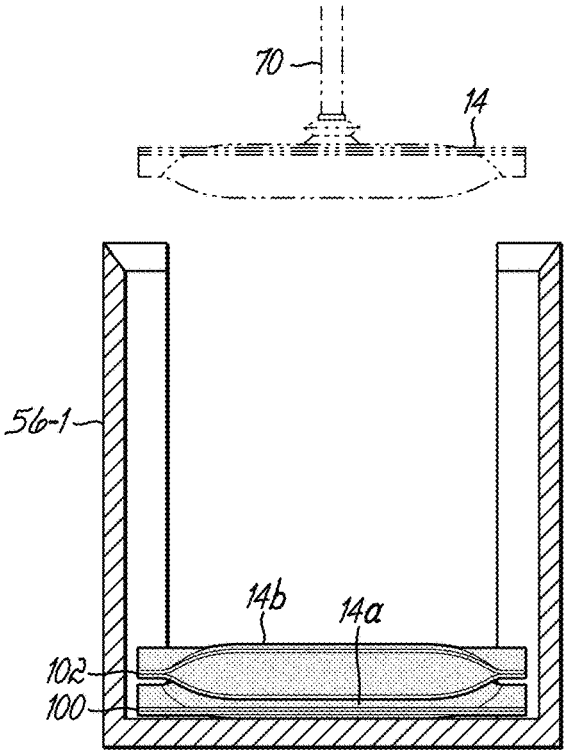

In the exemplary embodiment shown in FIGS. 12A-12F, the product picking device 58 deposits two pouches 14 in each cartoner bucket 56 before the cartoner bucket(s) 56 is advanced to the cartoning station 54. Referring now to FIGS. 12C-12D, once the picking operation of the product picking device 58 is complete, the product infeed device 52 may advance or index the leading cartoner bucket 56-1 to the cartoning station 54. This results in a new, empty cartoner bucket 56-7 being positioned at the loading end 53 of the product infeed device 52. Once the leading cartoner bucket 56-1 has been advanced, the product infeed device may complete another picking operation to deposit two pouches in cartoner buckets 56-2 and 56-4 in the same manner as described above with respect to cartoner buckets 56-1 and 56-3. At the completion of the picking operation, cartoner buckets 56-2 through 56-4 each include two pouches. The product infeed device 52 may then advance or index all three of the filled cartoner bucket 56-2 through 56-4 to the cartoning station 54. The process described above is then repeated to provide a steady flow of pouch-filled cartoner buckets 56 the cartoning station 54.

It will be understood that the above-described method of operating the product picking device 58 to deposit pouches 14 into one or more cartoner buckets 56 is merely exemplary and other sequences or configurations for depositing pouches into cartoner buckets 56 are possible. To this end, the sequence for delivering pouches 14 to cartoner buckets 56 will change based on a 2-count pick operation, 3-count pick operation, or 4-count pick operation of the product picking device 58.

With reference to FIG. 1C, a hole healing operation will be described in accordance with an embodiment of the present invention. In that regard, it is possible that the product delivery device 36 fails to deliver a pouch 14 onto one or both of the shuttles 78 positioned in the load zone 80*a*. This may happen for various reasons, such as a missed pick or from a pouch 14 being rejected upstream of the product delivery device 36. A missing pouch may be detected by the shuttles 78 or one or more photo-eye sensors, for example. In either case, if there is a missing pouch in the shuttle 78 in slot LZ1 or the shuttle 78 in LZ2, that shuttle 78 will not advance from the loading zone 80*a* to the transient zone 80*b*. Consequently, one or more shuttles 78 will not advance from the loading queue 80*f* into the loading zone 80*a*. For example, if the shuttle 78*a* in slot LZ1 does not receive a pouch, but the shuttle 78 in slot LZ2 does receive a pouch, only the shuttle 78 in slot LZ2 will move from the loading zone 80*a* to the transient zone 80*b* and into the picking queue 80*c*. That is, shuttle 78 in slot LZ1 remains in place and the shuttle 78 in slot LZ2 moves from the loading zone 80*a*→transient zone 80*b*→picking queue 80*c*. Furthermore, only one shuttle 78 advances from the loading queue 80*f* into the loading zone 80*a*. For example, one shuttle 78 will move from slot LQ2 in the loading queue 80*f* to slot LZ2 in the loading zone 80*a*. The shuttles 78 in slots LQ-LQ6 in the loading queue 80*f* then shift only one slot each to fill the empty slot LQ2. To this end, any hole created as a result of the missing pouch 14 is filled or healed, particularly as a result of the single orphan shuttle 78 (and pouch 14) being absorbed into the picking queue 80*c*.

Figure 13:
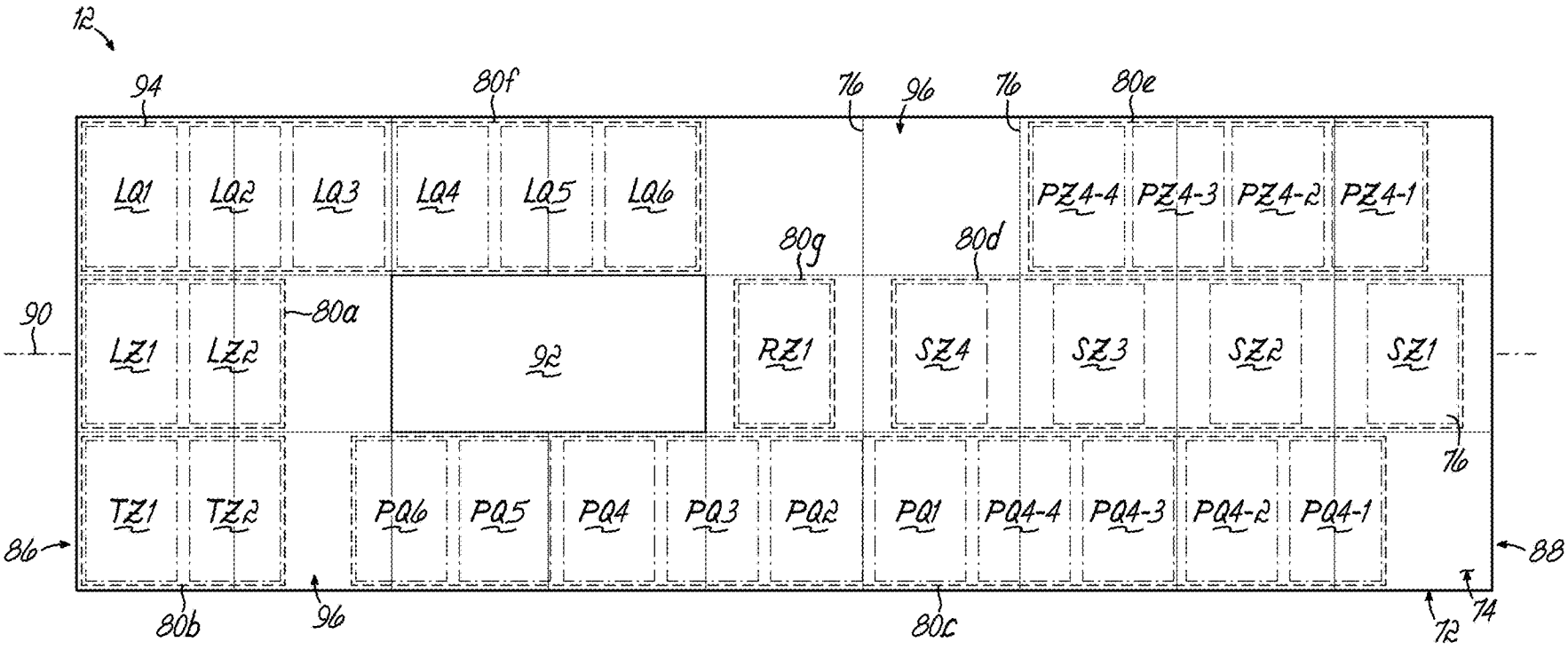
FIG. 13 is a schematic top view of the table of the product transfer apparatus, illustrating a product reject zone in accordance with another embodiment of the invention.

With reference to FIG. 13, a method of removing a defective pouch from the product flow will be described in accordance with an embodiment of the present invention. In that regard, like reference numerals represent like features compared to the embodiments described above with respect to FIGS. 1-12F. The primary differences between this embodiment and the previously described embodiment is that the table 72 of the product transfer apparatus 12 includes a reject zone 80*g* having at least one slot RZ1 for receiving a shuttle 78 carrying a defective pouch 14. In that regard, the table 72 includes at least one additional electromagnetic motor module 76 that defines the reject zone 80*g* and the slot RZ1. To this end, the slot RZ1 may be sized to accommodate the size and shape of a single shuttle 78, and it represents a possible pre-selected position of one of the shuttles 78 on the table 72 at an instant in time.

As described above, each shuttle 78 has the capability to detect the presence of a payload and measure its weight. As a result, each shuttle 78 is able to detect whether the weight of its payload (i.e., a pouch 14) greater than or less than a pre-determined expected weight of the payload. For example, a weight of each pouch may be determined once the pouch 14 is placed onto a respective shuttle 78 in the load zone 80*a* by the product delivery device 36. If a weight of the pouch is determined to be outside a pre-determined weight range for the pouches (i.e., underweight or overweight), the shuttle 78 and associated pouch 14 will be flagged as a defect. The pouch weight may be out of specification due to a weak or failed seal, for example. In any event, the shuttle 78 carrying the defective pouch 14 will move from the load zone 80*a* into the transient zone 80*b* and into the picking queue 80*c* in normal course as described above with respect to FIGS. 1-12F. However, once the shuttle 78 carrying the defective pouch 14 reaches a certain slot in the picking queue 80*c*, such as slot PQ2, the shuttle 78 carrying the defective pouch 14 is diverted to the reject zone 80*g*. The shuttle 78 may dwell in the reject zone 80*g* until the defective pouch 14 is removed from the shuttle 78 by a reject removal device. The defective pouch may be discarded or reworked, for example. The reject removal device may have a similar configuration and operation compared to the product picking device 58, for example. Once the defective pouch 14 is removed from the shuttle 78, the now empty shuttle moves from the reject zone 80*g* and into the loading queue 80*f*.

While the invention has been illustrated by the description of various embodiments thereof, and while the embodiments have been described in considerable detail, it is not intended to restrict or in any way limit the scope of the appended claims to such detail. Thus, the various features discussed herein may be used alone or in any combination. Additional advantages and modifications will readily appear to those skilled in the art. The invention in its broader aspects is therefore not limited to the specific details and illustrative examples shown and described. Accordingly, departures may be made from such details without departing from the scope of the general inventive concept.

What is claimed is:

1. A product transfer apparatus, comprising:

an electromagnetic motor table configured to define a plurality of pre-selected zones;

a plurality of moving elements configured to float over a surface of the electromagnetic motor table and move between one or more of the pre-selected zones;

a product delivery device configured to deposit one or more products in a pre-selected common orientation, relative to a longitudinal axis of the product transfer apparatus, onto one or more moving elements of the plurality of moving elements, respectively, at a first pre-selected zone of the plurality of pre-selected zones such that each of the one or more moving elements receives a single product from the product delivery device in the pre-selected common orientation at the first pre-selected zone;

a product picking device configured to pick a group of products constituted by one or more products from a pre-selected group of the plurality of moving elements at a second pre-selected zone of the plurality of pre-selected zones, wherein the orientation of one or more products of the group of products at the second pre-selected zone is different from the pre-selected common orientation of the products received at the first pre-selected zone by rotating an entire one or more of the plurality of moving elements of the pre-selected group so as to re-orient the one or more products of the group of products to be different in orientation at the second pre-selected zone than the pre-selected common orientation of the products received at the first pre-selected zone, and deposit the one or more products of the group of products into at least one cartoner bucket of a cartoner.

2. The apparatus of claim 1, wherein the first pre-selected zone is defined as a load zone of the electromagnetic motor table which is located within a spatial reach of the product delivery device.

3. The apparatus of claim 2, wherein the second pre-selected zone is defined as a pick zone of the electromagnetic motor table which is located within a spatial reach of the product picking device.

4. The apparatus of claim 1, wherein the electromagnetic motor table comprises a plurality of electromagnetic motor modules arranged in a predetermined planar layout, and further wherein each of the moving elements comprises a permanent magnet.

5. The apparatus of claim 1, wherein each of the moving elements is a shuttle configured to support and retain a single product thereon.

6. The apparatus of claim 3, wherein a third pre-selected zone of the plurality of pre-selected zones is defined as a staging zone of the electromagnetic motor table, and further wherein the orientation of the one or more products is selectively changed by rotating one or more of the pre-selected group of moving elements so that one or more products at the staging zone is oriented 180° relative to one or more other products at the staging zone.

7. The apparatus of claim 6, wherein the electromagnetic motor table is configured to define a loading queue independent of the plurality of pre-selected zones defined by the electromagnetic motor table which is located at one end operationally adjacent to the load zone of the product transfer apparatus, and further wherein the electromagnetic motor table is configured to define a picking queue independent of the plurality of pre-selected zones defined by the electromagnetic motor table which is located at one end operationally adjacent to the load zone of the product transfer apparatus and at an opposite end operationally adjacent to the staging zone of the product transfer apparatus.

8. The apparatus of claim 1, wherein the product delivery device comprises a rotatable picking arm, and wherein the product picking device comprises a delta robot.

9. The apparatus of claim 1, wherein the electromagnetic motor table is configured to define a plurality of discrete slots, with each slot defining a pre-selected position of one moving element of the plurality of moving elements at an instant in time, and further wherein each pre-selected zone of the plurality of pre-selected zones is defined by one or more slots of the plurality of slots.

10. The apparatus of claim 4, wherein the electromagnetic motor table is configured to define a plurality of discrete slots, with each slot defining a pre-selected position of one moving element of the plurality of moving elements at an instant in time, wherein each pre-selected zone of the plurality of pre-selected zones is defined by one or more slots of the plurality of slots, and wherein each of the electromagnetic motor modules comprises at least one slot of the plurality of discrete slots.

11. A multi-pack pouch cartoning system, comprising:

a horizontal form, fill and seal machine configured to form, fill and seal one or more individual pouches;

a pouch transfer apparatus, comprising:

an electromagnetic motor table configured to define a plurality of pre-selected zones;

a plurality of moving elements configured to float over a surface of the electromagnetic motor table and move between one or more of the pre-selected zones;

a pouch delivery device operatively connected to the horizontal form, fill and seal machine and configured to receive the individual pouches from the horizontal form, fill and seal machine and deposit one or more of the individual pouches in a pre-selected common orientation, relative to a longitudinal axis of the pouch transfer apparatus, onto one or more moving elements of the plurality of moving elements, respectively, at a first pre-selected zone of the plurality of pre-selected zones such that each of the one or more moving elements receives a single pouch from the pouch delivery device in the pre-selected common orientation at the first pre-selected zone;

a pouch picking device configured to pick a group of pouches constituted by one or more pouches from a pre-selected group of the plurality of moving elements at a second pre-selected zone of the plurality of pre-selected zones, wherein the orientation of one or more pouches of the group of pouches at the second pre-selected zone is different from the pre-selected common orientation of the pouches received at the first pre-selected zone by rotating an entire one or more of the plurality of moving elements of the pre-selected group so as to re-orient the one or more pouches of the group of pouches to be different in orientation at the second pre-selected zone than the pre-selected common orientation of the pouches received at the first pre-selected zone; and a cartoner machine including the at least one cartoner bucket.

12. The cartoning system of claim 11, wherein the orientation of the one or more pouches is selectively changed by rotating one or more of the pre-selected group of moving elements so that one or more pouches at the second pre-selected zone is oriented 180° relative to one or more other pouches at the second pre-selected zone.

13. The cartoning system of claim 11, wherein the pouch delivery device comprises a rotatable picking arm, and wherein the pouch picking device comprises a delta robot.

* * * * *